US011567442B2

(12) United States Patent
Hirahara

(10) Patent No.: US 11,567,442 B2
(45) Date of Patent: Jan. 31, 2023

(54) IMAGE FORMING APPARATUS INCLUDING A SKELETON FRAME

(71) Applicant: KYOCERA Document Solutions Inc., Osaka (JP)

(72) Inventor: Kazuhisa Hirahara, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 7 days.

(21) Appl. No.: 17/238,290

(22) Filed: Apr. 23, 2021

(65) Prior Publication Data

US 2021/0333741 A1 Oct. 28, 2021

(30) Foreign Application Priority Data

Apr. 27, 2020 (JP) ..... JP2020-078195

(51) Int. Cl.
*G03G 21/16* (2006.01)

(52) U.S. Cl.
CPC ..... *G03G 21/1619* (2013.01); *G03G 21/1647* (2013.01); *G03G 2221/1684* (2013.01)

(58) Field of Classification Search
CPC ..... G03G 21/1619; G03G 21/1647; G03G 2221/1684
See application file for complete search history.

(56) References Cited

U.S. PATENT DOCUMENTS

2008/0240781 A1* 10/2008 Murano ..... G03G 21/1647 399/122
2011/0280614 A1* 11/2011 Yamauchi ..... G03G 21/1619 399/107
2015/0090060 A1* 4/2015 Kobayashi ..... G03G 21/1647 74/412 R
2016/0009510 A1* 1/2016 Kawai ..... G03G 21/1619 271/145

FOREIGN PATENT DOCUMENTS

JP 2000-138470 5/2000

* cited by examiner

*Primary Examiner* — Sandra Brase
(74) *Attorney, Agent, or Firm* — Lex IP Meister, PLLC

(57) ABSTRACT

A skeleton frame has a pair of corner columns facing each other. An image forming apparatus includes a pair of support shafts protruding inward from respective inner side surfaces in the pair of corner columns, and an opening/closing member rotatably supported on a lower end portion by the pair of support shafts. A specific member moves horizontally from an outer side of the skeleton frame through between the pair of corner columns and is attached inside the skeleton frame. At least one of the pair of support shafts is also used as a guide portion that guides the specific member when the specific member is inserted into the skeleton frame through between the pair of corner columns.

8 Claims, 19 Drawing Sheets

IMAGE FORMING APPARATUS INCLUDING A SKELETON FRAME

INCORPORATION BY REFERENCE

This application is based upon, and claims the benefit of priority from, corresponding Japanese Patent Application No. 2020-078195 filed in the Japan Patent Office on Apr. 27, 2020, the entire contents of which are incorporated herein by reference.

BACKGROUND

Field of the Invention

The present disclosure relates to an image forming apparatus.

Description of Related Art

Typically, an image forming apparatus including a skeleton frame composed of a combination of hollow columns and cross beams is known. In this skeleton frame, columns and cross beams are composed of square pipes each having a quadrangular cross section. An image forming unit that executes an image forming process and a fixing unit that heat-fixes a toner image formed on paper by the image forming unit are attached in the skeleton frame. One side surface of the skeleton frame is covered with an opening/closing cover for maintenance.

SUMMARY

The image forming apparatus according to one aspect of the present disclosure includes a skeleton frame formed by combining hollow columns and cross beams, and a specific member attached in the skeleton frame.

The skeleton frame has a pair of corner columns facing each other at an interval, a pair of support shafts projecting inward from respective inner side surfaces in the pair of corner columns, and an opening/closing member that is rotatably supported on a lower end portion by the pair of support shafts and is capable of opening/closing a space between the pair of corner columns by rotating around the pair of support shafts as fulcrums. The specific member moves horizontally from an outer side of the skeleton frame through between the pair of corner columns and is attached inside the skeleton frame, and at least one of the pair of support shafts is also used as a guide portion that guides the specific member when the specific member is inserted into the skeleton frame from between the pair of corner columns.

An image forming apparatus according to another aspect of the present disclosure includes a skeleton frame formed by combining hollow columns and cross beams, and a specific member attached in the skeleton frame.

The skeleton frame has a pair of corner columns facing each other at an interval a pair of support shafts projecting inward from respective inner side surfaces in the pair of corner columns, an opening/closing member that is rotatably supported on a lower end portion by the pair of support shafts and is capable of opening/closing a space between the pair of corner columns by rotating around the pair of support shafts as fulcrums, a hook member mounted on the opening/closing member and projecting inward in an opening/closing direction of the opening/closing member, and a pair of engaging shafts provided in a protruding manner on an inner side surface of a sheet metal member connected to each of the pair of corner columns and holding the opening/closing member in a closed state by engaging with the pair of hook members when the opening/closing member shifts from an open state to the closed state. The specific member moves horizontally from the outer side of the skeleton frame through between the pair of corner columns and is attached inside the skeleton frame, and at least one of the pair of engaging shafts is also used as a guide portion that guides the specific member when the specific member is inserted into the skeleton frame from between the corner columns.

DETAILED DESCRIPTION

Hereinafter, an embodiment of the present disclosure will be described in detail on the basis of the drawings. It is to be noted that the present disclosure is not limited to the following embodiment.

Embodiment

Figure 1:
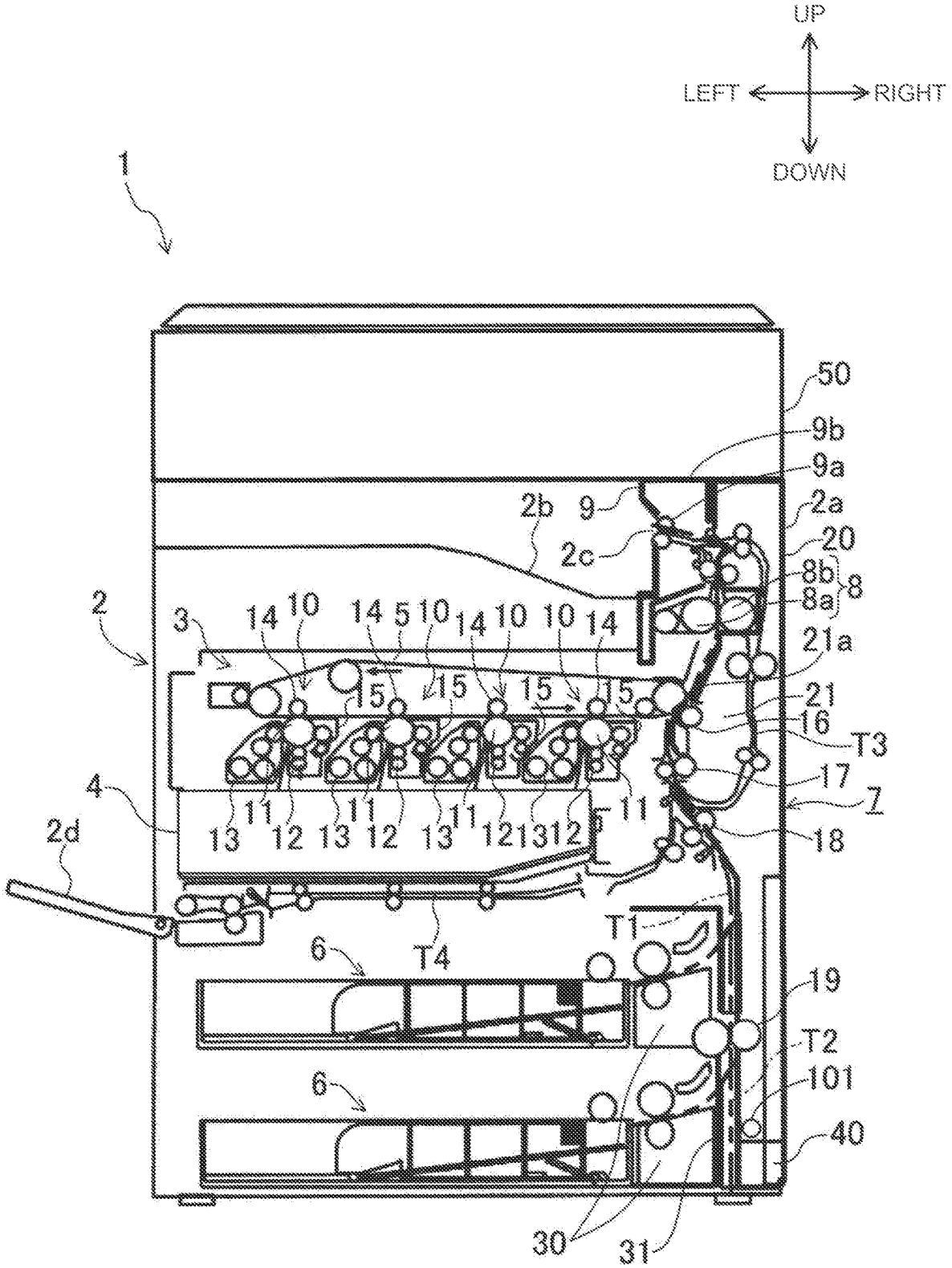
FIG. 1 is a schematic configuration diagram showing an image forming apparatus in an embodiment.

FIG. 1 is a schematic configuration diagram showing an image forming apparatus 1 in an embodiment. In the following description, a front side, a rear side, a left side, and a right side are directions with reference to the image forming apparatus 1, and definition of the direction axis shown in each figure shall be followed.

Entire Configuration of Image Forming Apparatus

The image forming apparatus 1 is composed of, for example, an in-body paper-ejection type copying machine, and has an image forming apparatus main body 2 and an image reading device 50 provided on an upper side of the image forming apparatus main body 2. The image reading device 50 optically reads an original image and generates image data thereof.

An image forming portion 3 for transferring and forming an image on paper on the basis of the image data of the original read by the image reading device 50 is provided in the image forming apparatus main body 2. An exposure device 4 that emits a laser beam is arranged below the image forming portion 3, and a transfer belt 5 is arranged above the image forming portion 3. Below the exposure device 4, paper feeding portions 6 for storing paper, which is an example of a sheet, are arranged in two stages, that is, upper and lower stages. Above the right side of the transfer belt 5, a fixing unit 8 for fixing an image transferred and formed on paper is arranged. Above the image forming apparatus main body 2, an ejection unit 9 for ejecting the paper having been fixed by the fixing unit 8 into an ejection tray 2*b* formed on an upper surface of the image forming apparatus main body 2 is provided. In the image forming apparatus main body 2, a main conveying path T1 extending from the paper feeding portion 6 toward the ejection tray 2*b*, an optional conveying path T2 extending upward from the lower end of the image forming apparatus main body 2 and merging with the main conveying path T1, a reversing conveying path T3 branching from an upstream end of the main conveying path T1 and merging with an intermediate portion in a vertical direction of the main conveying path T1, and a manual-feed conveying path T4 extending from a manual paper-feed tray 2*d* on the left side surface of the image forming apparatus main body 2 in the horizontal direction and merging with the main conveying path T1 are provided. The optional conveying path T2 (specific sheet conveying path) is used, for example, when an optional paper-feed cassette is added to the lower side of the image forming apparatus main body 2.

A rectangular opening 7 is formed in a right side wall portion 2*a* adjacent to the main conveying path T1 and the optional conveying path T2 in the image forming apparatus main body 2. The opening 7 is closed by an opening/closing cover 20 (an example of an opening/closing member) and an auxiliary cover 40. When an optional paper-feed cassette is added, the opening/closing member of the optional paper-feed cassette projects to the lower end of the opening/closing cover 20 instead of the auxiliary cover 40 and closes the opening 7.

The image forming portion 3 includes four image forming units 10 arranged in a row along the transfer belt 5. Each of the image forming units 10 has a photosensitive drum 11. Directly under each photosensitive drum 11, a charger 12 is arranged, on the left side of each photosensitive drum 11, a developing device 13 is arranged, directly above each photosensitive drum 11, a primary transfer roller 14 is arranged, and on the right side of each photosensitive drum 11, a cleaning portion 15 for cleaning a peripheral surface of the photosensitive drum 11 is arranged.

The peripheral surface of each photosensitive drum 11 is uniformly charged by the charger 12, and laser beams corresponding to each color based on image data input from the computer or the like are emitted from the exposure device 4 to the peripheral surface of each photosensitive drum 11 after the charging. As a result, an electrostatic latent image is formed on the peripheral surface of each photoconductive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a primary transfer bias applied to the primary transfer roller 14.

A secondary transfer roller 16 is arranged on the right side of the transfer belt 5. The secondary transfer roller 16 is arranged in contact with the transfer belt 5. The secondary transfer roller 16 sandwiches the paper conveyed from each paper feeding portion 6 along the main conveying path T1 with the transfer belt 5. A secondary transfer bias is applied to the secondary transfer roller 16, and the toner image on the transfer belt 5 is transferred to the paper by the applied secondary transfer bias.

The fixing unit 8 is provided on a conveying downstream side of the secondary transfer roller 16 in the main conveying path T1. The fixing unit 8 is configured by accommodating a heating roller 8*a* and a pressure roller 8*b* that are in pressure contact with each other in a fixing housing (not shown). Then, the fixing unit 8 heats the paper while pressurizing it by sandwiching the paper between the heating roller 8*a* and the pressure roller 8*b*. Then, the fixing unit 8 fixes the toner image transferred to the paper to the paper. The paper after the fixing process is sent toward the ejection unit 9.

The ejection unit 9 has an ejection roller pair 9*a* arranged near a paper ejection port 2*c* and a housing 9*b* having the ejection roller pair 9*a*. Then, the ejection unit 9 receives the paper sent from the fixing unit 8 and ejects the paper to the ejection tray 2*b* by the ejection roller pair 9*a*. When double-sided printing is to be performed on the paper, after single-sided printing is completed, the paper is switched back by the ejection roller pair 9*a* to be supplied to a reversing conveying path T3, and the paper is re-supplied to the main conveying path T1 via the reversing conveying path T3. Further, when printing is to be performed on the paper set in the manual paper-feed tray 2*d*, the paper is supplied to the main conveying path T1 via the manual-feed conveying path T4, and the printing is performed on the paper by the image forming portion 3.

Structure of Opening/Closing Cover 20

The opening/closing cover 20 is capable of opening/closing, and when a jam occurs in the main conveying path T1 or the optional conveying path T2, the jammed paper can be easily removed by opening the opening/closing cover 20. Specifically, the opening/closing cover 20 is formed having a substantially rectangular plate shape corresponding to the shape of the opening 7. Both side surfaces in a width direction of the lower end portion of the opening/closing cover 20 are rotatably supported by the support shaft 101, respectively. Each support shaft 101 is attached to the skeleton frame 100 (see FIG. 2) of the image forming apparatus 1 as will be described later. Each support shaft 101 is inserted into a support hole formed on both side surfaces in the width direction of the opening/closing cover 20. Then, the opening/closing cover 20 opens/closes the opening 7 by rotating around the pair of support shafts 101. FIG. 1 shows a closed state in which the opening/closing cover 20 closes the opening 7. The opening/closing cover 20 is opened by rotating from this closed state to the outer side (right side in FIG. 1) of the image forming apparatus main body 2 with the pair of support shafts 101 as fulcrums.

A conveying-path forming member 21 is attached to an inner wall surface 20*a* (inner side surface of the image forming apparatus 1) of the opening/closing cover 20. The reversing conveying path T3 connected to the main conveying path T1 is formed in an upper half of the conveying-path forming member 21. A paper guide surface 21*a* extending along the main conveying path T1 and the optional conveying path T2 is formed on a left side surface of the conveying-path forming member 21.

The paper guide surface 21*a* includes a secondary transfer roller 16, one roller of a resist roller pair 17, one roller of a conveying roller pair 18, and one roller of a conveying roller pair 19.

A paper-feed base member 31 is provided on a lower end portion of the conveying-path forming member 21 on a side opposite to the optional conveying path T2. The other roller of the conveying roller pair 19 (the roller facing the one roller of the conveying roller pair 19) is supported on a right side surface of the paper-feed base member 31. Further, a paper feed unit 30 corresponding to the upper and lower paper feeding portions 6 is supported inside the paper-feed base member 31. As will be described later, the paper-feed base member 31 is inserted into the skeleton frame 100 of the image forming apparatus main body 2 from the right side.

Structure of Skeleton Frame 100

Figure 2:
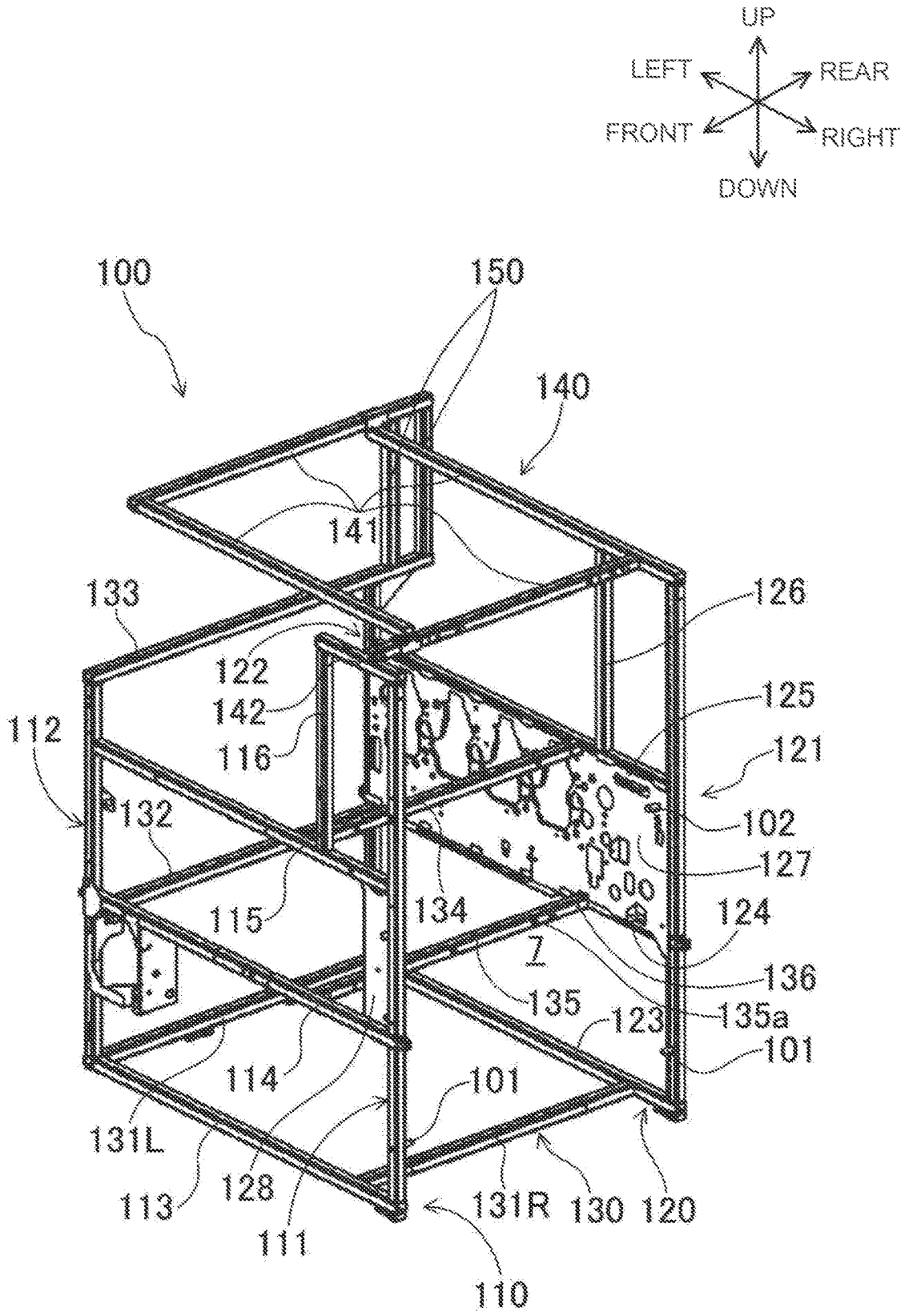
FIG. 2 is a perspective view showing a skeleton frame of the image forming apparatus in the embodiment.

As shown in FIG. 2, the skeleton frame 100 is composed by combining hollow columns and beams, and each of the columns and the cross beams is composed of, for example, a hollow pipe having a rectangular cross section.

More specifically, the skeleton frame 100 has a front frame portion 110 and a rear frame portion 120 arranged at an interval in the front-rear direction (an example of a specific direction), a connecting portion 130 which connects the both frame portions 110 and 120 to each other, and an upper-end frame portion 140 connected to and supported on upper ends of the both frame portions 110 and 120.

The front frame portion 110 includes a first corner column 111 and a second corner column 112 extending in a vertical direction at the left and right corners on the front side of the skeleton frame 100, and three cross beams 113, 114, and 115 which extend in the left-right direction and connect the first corner column 111 and the second corner column 112 to each other.

The three cross beams 113, 114, and 115 extend horizontally in the left-right direction, respectively. The cross beam 113 connects the lower end portion of the first corner column 111 and the lower end portion of the second corner column 112. The other two cross beams 114 and 115 connect an intermediate portion in the vertical direction of the first corner column 111 and an intermediate portion in the vertical direction of the second corner column 112. The cross beam 114 is arranged at an interval on an upper side with respect to the cross beam 113, and the cross beam 115 is arranged at an interval on an upper side with respect to the cross beam 114. A rectangular plate-shaped sheet metal member 128 that is long in the vertical direction is provided at a right end portion between the cross beam 114 and the cross beam 115. The sheet metal member 128 is connected and fixed to the first corner column 111, the cross beam 114, and the cross beam 115. In the present embodiment, in the front frame portion 110, the first corner column 111 and the second corner column 112 are vertically divided with the cross beam 114 interposed therebetween, but the present disclosure is not limited to this, and each of the corner columns 111 and 112 may be composed of one column, or may be divided into three or more.

The rear frame portion 120 includes a third corner column 121 and a fourth corner column 122 extending in the vertical direction at the left and right corners on the rear side of the skeleton frame 100, and has three cross beams 123, 124, 125 which extend in the left-right direction and connect the third corner column 121 and the fourth corner column 122 to each other.

The three cross beams 123, 124, and 125 extend horizontally in the left-right direction, respectively. The cross beam 123 connects the lower end portion of the third corner column 121 and the lower end portion of the fourth corner column 122. The other two cross beams 124 and 125 connect an intermediate portion in the vertical direction of the third corner column 121 and an intermediate portion in the vertical direction of the fourth corner column 122. The cross beam 124 is arranged at an interval on an upper side with respect to the cross beam 123, and the cross beam 125 is arranged at an interval on an upper side with respect to the cross beam 124. These two cross beams 124 and 125 are located at the same height as the cross beams 114 and 115 of the front frame portion 110, respectively. A sheet metal member 127 that is brought into contact with a rear end surfaces of the image forming units 10 in each color is attached to the two cross beams 124 and 125. The sheet metal member 127 is also connected to the third corner column 121. In the present embodiment, in the rear frame portion 120, the third corner column 121 and the fourth corner column 122 are vertically divided with the cross beam 124 interposed therebetween, but the present disclosure is not limited to this, and each of the corner columns 121 and 122 may be composed of one column, or may be divided into three or more.

The connecting portion 130 has a pair of lower-end connecting beams 131, an intermediate connecting beam 132, an upper-end connecting beam 133, an upper auxiliary connecting beam 134, and a lower auxiliary connecting beam 135. Each of the connecting beams 131 to 135 extends horizontally in the front-rear direction. In the following description, when it is necessary to distinguish the left and right of the lower-end connecting beam 131, the subscripts L and R corresponding to the left side and the right side shall be added.

The pair of lower-end connecting beams 131 are arranged at an interval in the left-right direction. A lower-end connecting beam 131L on the left side connects the lower end portion of the second corner column 112 included in the front frame portion 110 and the lower end portion of the fourth corner column 122 included in the rear frame portion 120. A lower-end connecting beam 131R on the right side connects the cross beam 113 included in the front frame portion 110 and the cross beam 123 included in the rear frame portion 120. The lower-end connecting beam 131R on the right side is arranged at a position offset to the left side of the first corner column 111 and the third corner column 121. The intermediate connecting beam 132 connects an intermediate portion in the vertical direction of the second corner column 112 included in the front frame portion 110 and an intermediate portion in the vertical direction of the fourth corner column 122 included in the rear frame portion 120. The upper-end connecting beam 133 connects an upper end of the second corner column 112 included in the front frame portion 110 and an upper end of the fourth corner column 122 included in the rear frame portion 120. The upper auxiliary connecting beam 134 connects an intermediate portion in the left-right direction of the cross beam 115 included in the front frame portion 110 and an intermediate portion in the left-right direction of the cross beam 125 included in the rear frame portion 120. The lower auxiliary connecting beam 135 connects an intermediate portion in the left-right direction of the cross beam 114 included in the front frame portion 110 and an intermediate portion in the left-right direction of the cross beam 124 included in the rear frame portion 120. The lower auxiliary connecting beam 135 is formed with a pair of front and rear positioning holes 135*a* (only one is shown in FIG. 2) for positioning the above-mentioned paper-feed base member 31.

The upper-end frame portion 140 is composed by connecting four cross beams 141 in a rectangular frame shape that is long in the left-right direction. An upper surface of the upper-end frame portion 140 functions as a mounting surface for the image reading device 50. A right and rear end portion of the upper-end frame portion 140 is connected to and supported by an upper end of the third corner column 121 and an upper end of a reinforcing column 126. Moreover, a right and front end portion of the upper-end frame portion 140 is connected to and supported by an upper end of the first corner column 111 and an upper end of the reinforcing column 116 via the connecting beam 142. Further, a left and rear end portion of the upper-end frame portion 140 is connected to and supported by an upper surface of the upper-end connecting beam 133 via a pair of support columns 150.

Support Structure of the Opening/Closing Cover 20 for the Skeleton Frame 100

Figure 3:
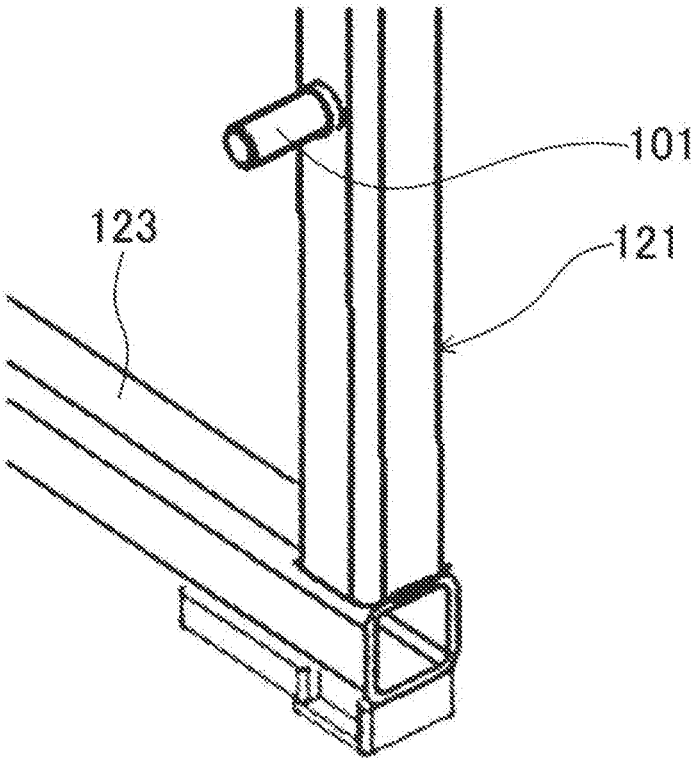
FIG. 3 is an enlarged perspective view showing a support shaft of an opening/closing cover attached to a third corner column of the skeleton frame in an enlarged manner.
Figure 4:
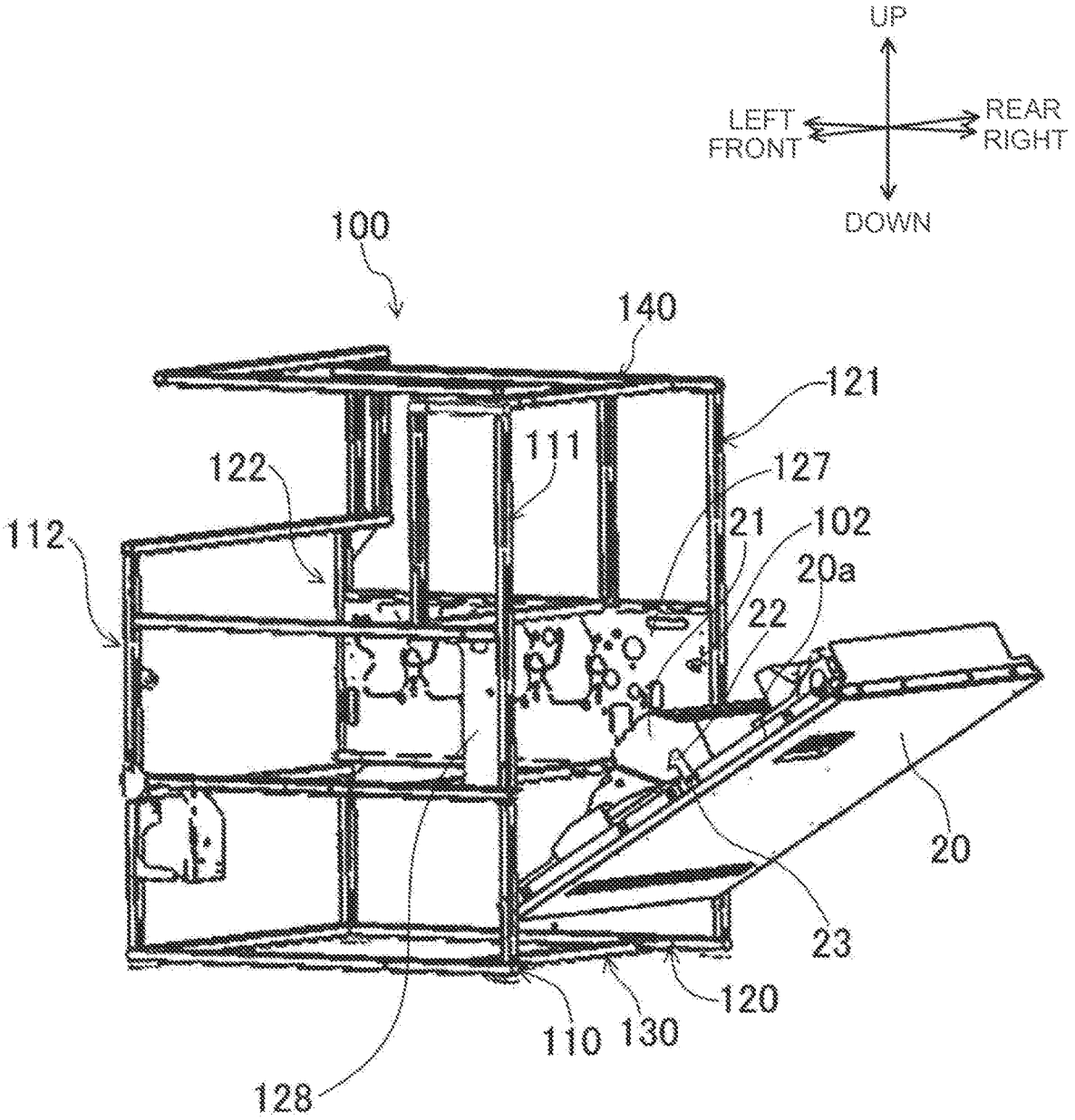
FIG. 4 is a perspective view showing the skeleton frame and the opening/closing cover attached to the skeleton frame and in an open state.
Figure 5:
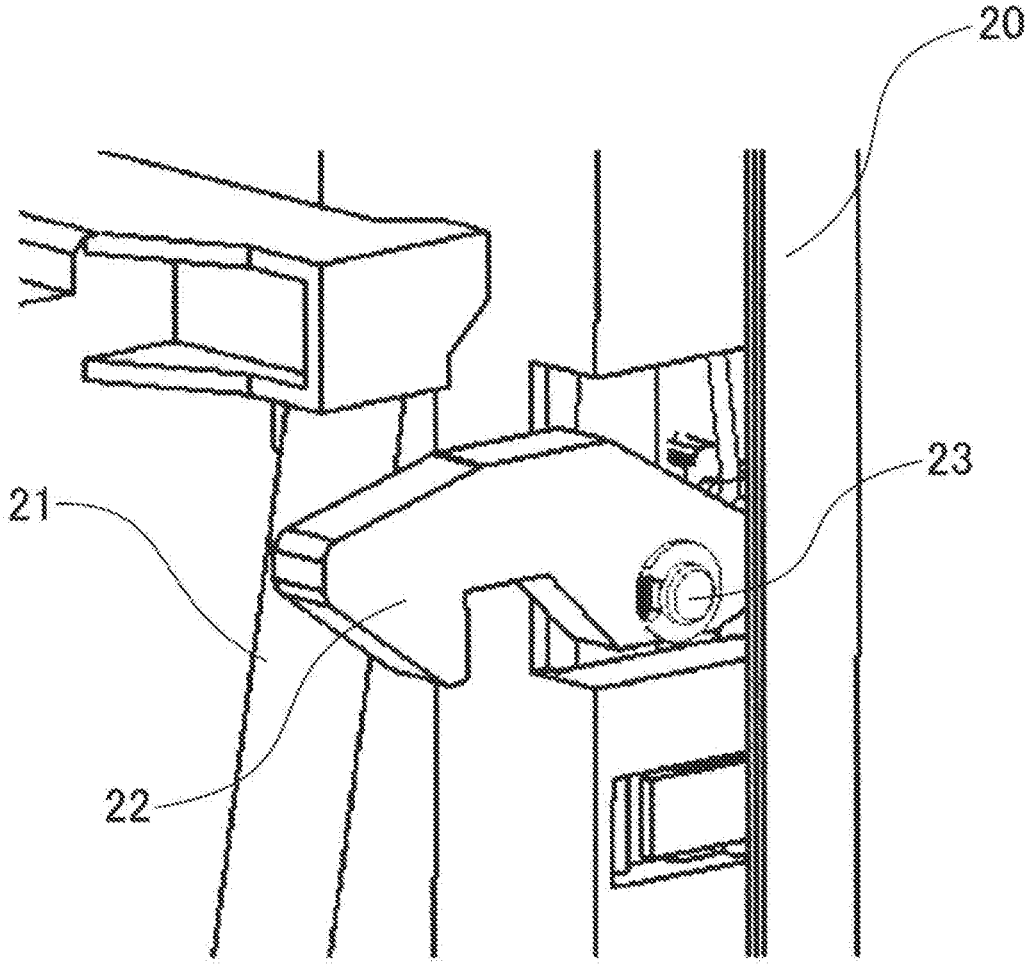
FIG. 5 is a perspective view showing a hook member attached to the opening/closing cover.

The support structure of the opening/closing cover 20 with respect to the skeleton frame 100 will be described with reference to FIGS. 2 to 4. As shown in FIG. 2, the pair of support shafts 101 that support the opening/closing cover 20 are arranged so as to project inward from the lower end portions of the inner side surfaces of the first corner column 111 and the third corner column 121. As shown in FIG. 3, each support shaft 101 is composed of a metal columnar pin. As shown in FIG. 4, hook members 22 (only one of them is shown in FIG. 4) are attached to both side end portions in a width direction of the opening/closing cover 20. Each hook member 22 projects inward in an opening/closing direction of the opening/closing cover 20. As shown FIG. 5 in an enlarged manner, each hook member 22 is supported swingably on a base end portion by a swing shaft 23, and is urged by an urging member, not shown, in the counterclockwise direction of FIG. 5 (that is, in a direction where a distal end portion is lowered) at all times. Then, when the opening/closing cover 20 shifts from an open position to a fully closed position, the hook member 22 engages with an engaging shaft 102 provided on the skeleton frame 100, so that the opening/closing cover 20 is held in the closed position.

As shown in FIG. 2, the engaging shaft 102 projects inward from the inner side surfaces of the sheet metal member 127 and the sheet metal member 128 facing each other in the skeleton frame 100. The engaging shaft 102 is composed of a metal columnar pin similarly to the support shaft 101.

Structure of Paper-Feed Base Member 31

Figure 6:
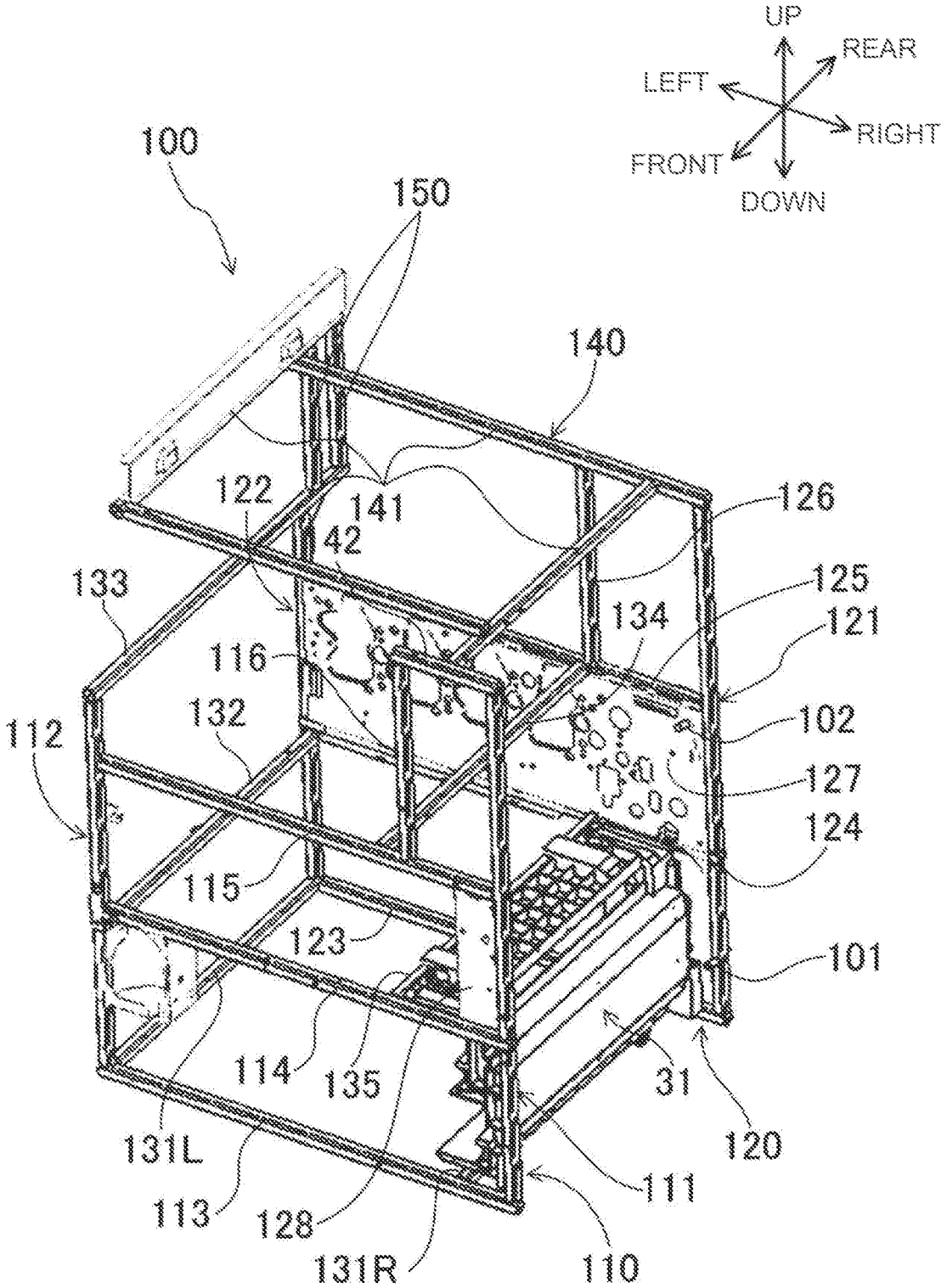
FIG. 6 is a perspective view showing a state in which a paper-feed base member is attached to the skeleton frame.
Figure 7:
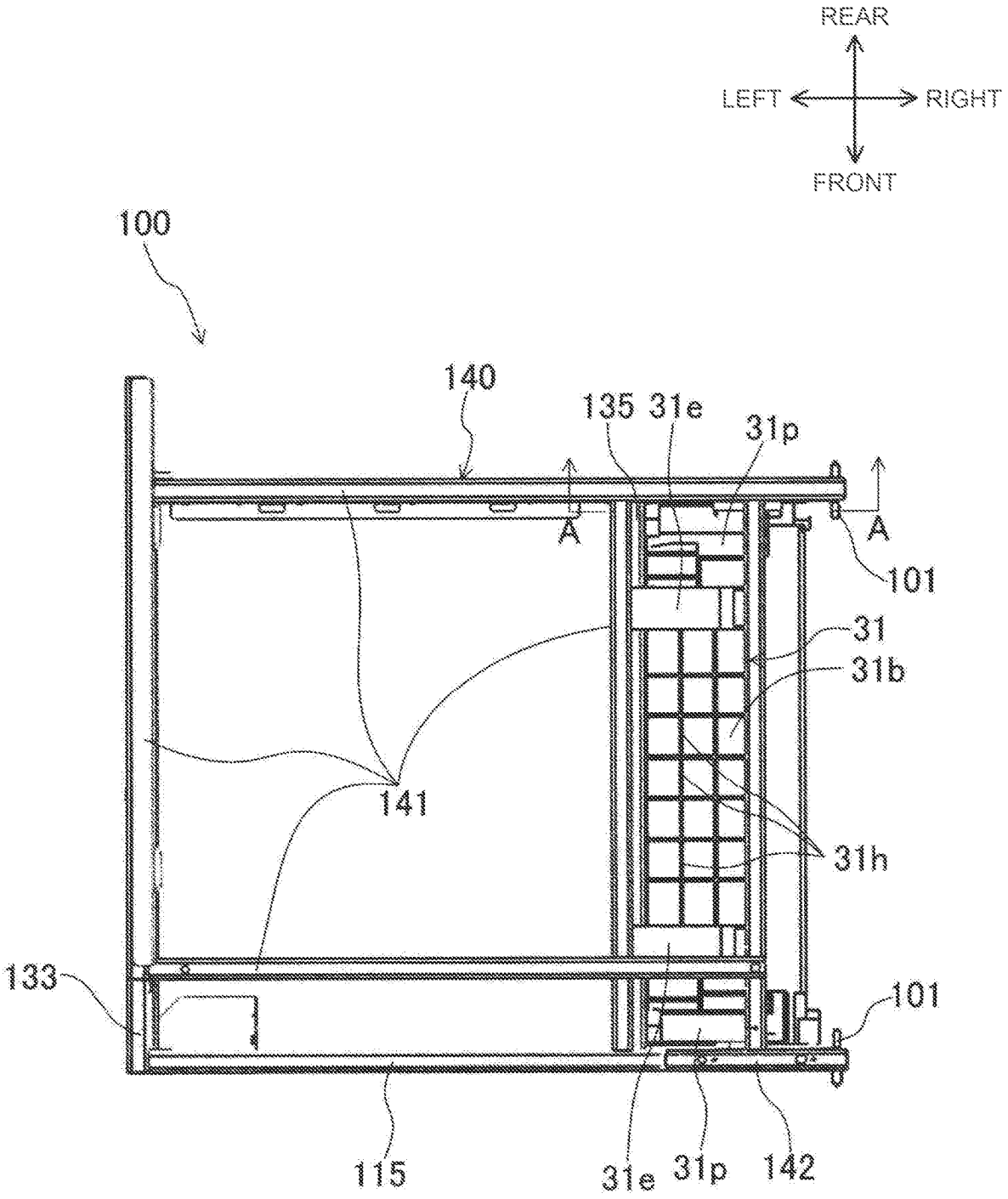
FIG. 7 is a plan view showing a state in which the paper feed base member is attached to the skeleton frame.

FIGS. 6 and 7 are a perspective view and a plan view showing a state in which the paper-feed base member 31 is attached to the skeleton frame 100, respectively.

Before assembling the opening/closing cover 20 to the skeleton frame 100, the paper-feed base member 31 is inserted into the skeleton frame 100 from between the first corner column 111 and the third corner column 121 provided at two corners on the right side of the skeleton frame 100.

The paper-feed base member 31 extends over the entire lower end portion in the front-rear direction of the skeleton frame 100, and the right side surface of the paper-feed base member 31 forms the optional conveying path T2 (specific sheet conveying path).

Figure 8:
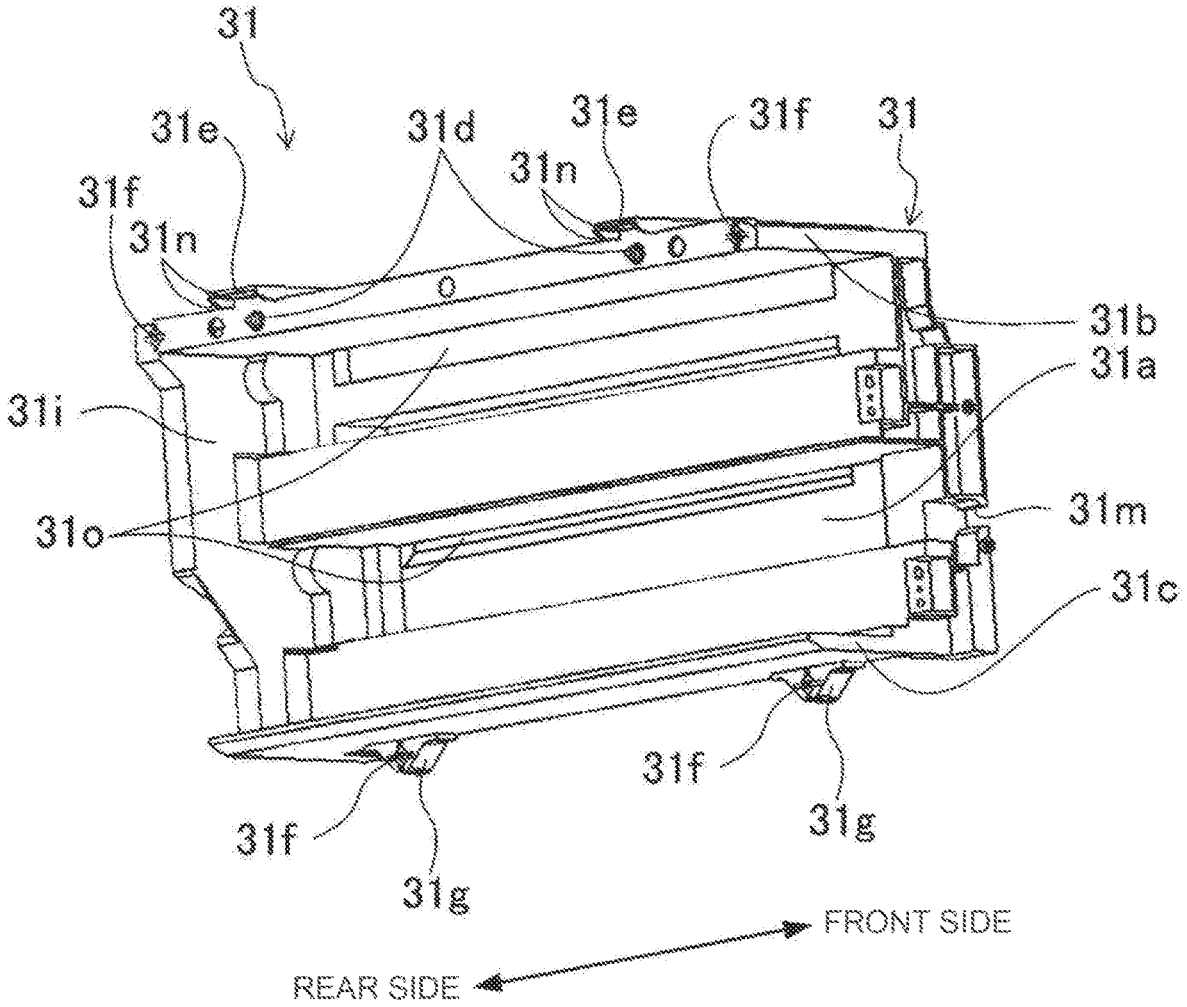
FIG. 8 is a perspective view showing a guide member.
Figure 9:
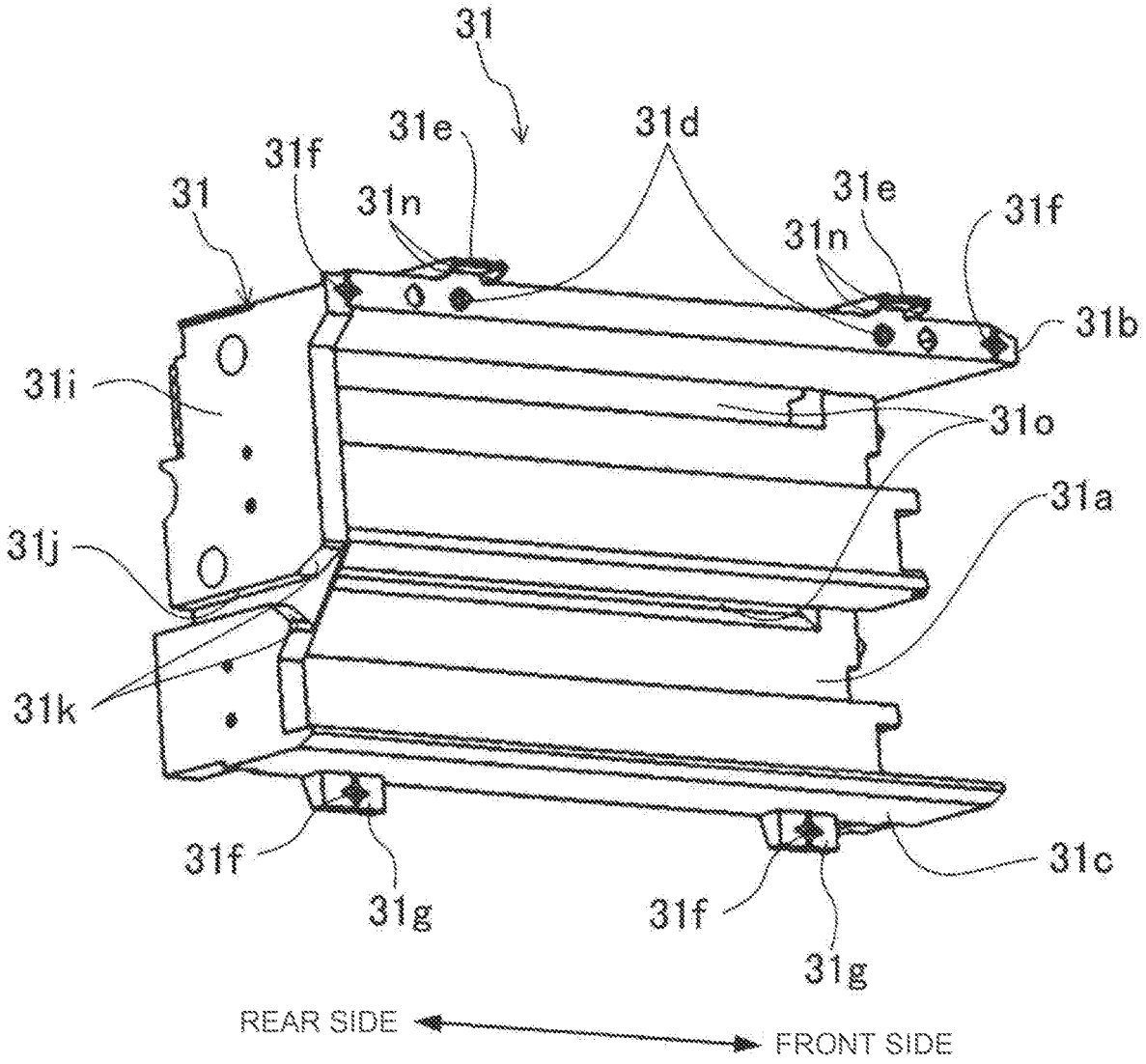
FIG. 9 is a perspective view showing the guide member.

As shown in FIGS. 8 and 9, the paper-feed base member 31 includes a vertical guide portion 31*a* extending in the vertical direction and the front-rear direction, an upper horizontal portion 31*b* protruding to the left from an upper end portion of the vertical guide portion 31*a*, a lower horizontal portion 31*c* protruding to the left from a lower end portion of the vertical guide portion 31*a*, and a rear vertical wall portion 31*i* extending in the vertical direction and connecting rear end portions of the upper horizontal portion 31*b* and the lower horizontal portion 31*c*.

The right side surface of the vertical guide portion 31*a* functions as a guide surface that guides the sheet along the optional conveying path T2 (specific sheet conveying path). The vertical guide portion 31*a* has a carry-in inlet 31*o* for a sheet conveyed from each paper feeding portion 6 to pass through formed by extending in the front-rear direction. The sheet of each paper feeding portion 6 is conveyed to the conveying path T1 through the carry-in inlet 31*o*. An insertion groove 31*m* (shown only in FIG. 8) penetrating in the left-right direction is formed at a front end portion of the vertical guide portion 31*a*. The insertion groove 31*m* is formed so that the support shaft 101 on the front side passes therethrough when the paper-feed base member 31 is inserted into the skeleton frame 100.

A pair of boss portions 31*d* project from an end surface of the upper horizontal portion 31*b* on the protruding side. The pair of boss portions 31*d* are formed at an interval in the front-rear direction, and each of the boss portions 31*d* engages with a pair of positioning holes 135*a* (see FIG. 2) formed in the lower auxiliary connecting beam 135 of the skeleton frame 100, whereby the paper-feed base member 31 is positioned. The boss portion 31*d* corresponds to an engaging portion, and the positioning hole 135*a* corresponds to an engaged portion.

The upper horizontal portion 31*b* further has a pair of protruding guide portions 31*e* formed by being arranged so as to cover the upper side of each of the boss portions 31*d*. The protruding guide portion 31*e* protrudes from each of the boss portions 31*d* to the front side in the insertion direction (left side of the image forming apparatus 1). The protruding guide portion 31*e* is formed having a U shape that opens downward when viewed from the front side in the insertion direction, and a distal end portion on a lower end side of the protruding guide portion 31*e* is composed of a pair of inclined edges 31*n* (corresponding to inclined portions) inclined upward toward the front side in the insertion direction.

Mounting holes 31*f* penetrating in the left-right direction are formed at both end portions in the front-rear direction of the upper horizontal portion 31*b*. As shown in FIG. 7, a grid-like rib plate 31*h* is provided in a protruding manner on the upper surface portion of the upper horizontal portion 31*b*. A counterbore 31*p* extending in the left-right direction is formed at a position corresponding to the mounting hole 31*f* on the upper surface of the upper horizontal portion 31*b*. When the paper-feed base member 31 is to be fixed to the skeleton frame 100, a robot inserts a screw 32 into the mounting hole 31*f* along the counterbore as described later.

As shown in FIGS. 8 and 9, a pair of mounting plates 31*g* arranged at an interval in the front-rear direction are provided in a protruding manner on the lower surface of the lower horizontal portion 31*c*. Each of the mounting plates 31*g* is formed with the mounting hole 31*f* that penetrates in the thickness direction. Then, in the paper-feed base member 31, the sum of the two mounting holes 31*f* formed in the upper horizontal portion 31*b* and the two mounting holes 31*f* formed in the pair of mounting plates 31*g* in the lower horizontal portion 31*c*, that is, the four mounting holes 31*f* in total are provided.

On the rear side surface (one side surface) of the rear vertical wall portion 31*i*, a guide groove 31*j* (groove portion) having a U-shaped cross section that opens to the rear side is formed. The guide groove 31*j* is located below the central portion in the vertical direction of the rear vertical wall portion 31*i* and formed over the entirety in the left-right direction of the rear vertical wall portion 31*i*.

A pair of upper and lower chamfered portions 31*k* are formed having a divergent shape at the left end portion of the guide groove 31*j*. By providing the chamfered portion 31*k*, the support shaft 101 on the rear side can be easily guided into the guide groove 31*j* and engaged with the paper-feed base member 31 when the attachment work of the paper-feed base member 31 is performed.

Structure of the Mounting Portion of the Paper-Feed Base Member 31 in the Skeleton Frame 100

Figure 10:
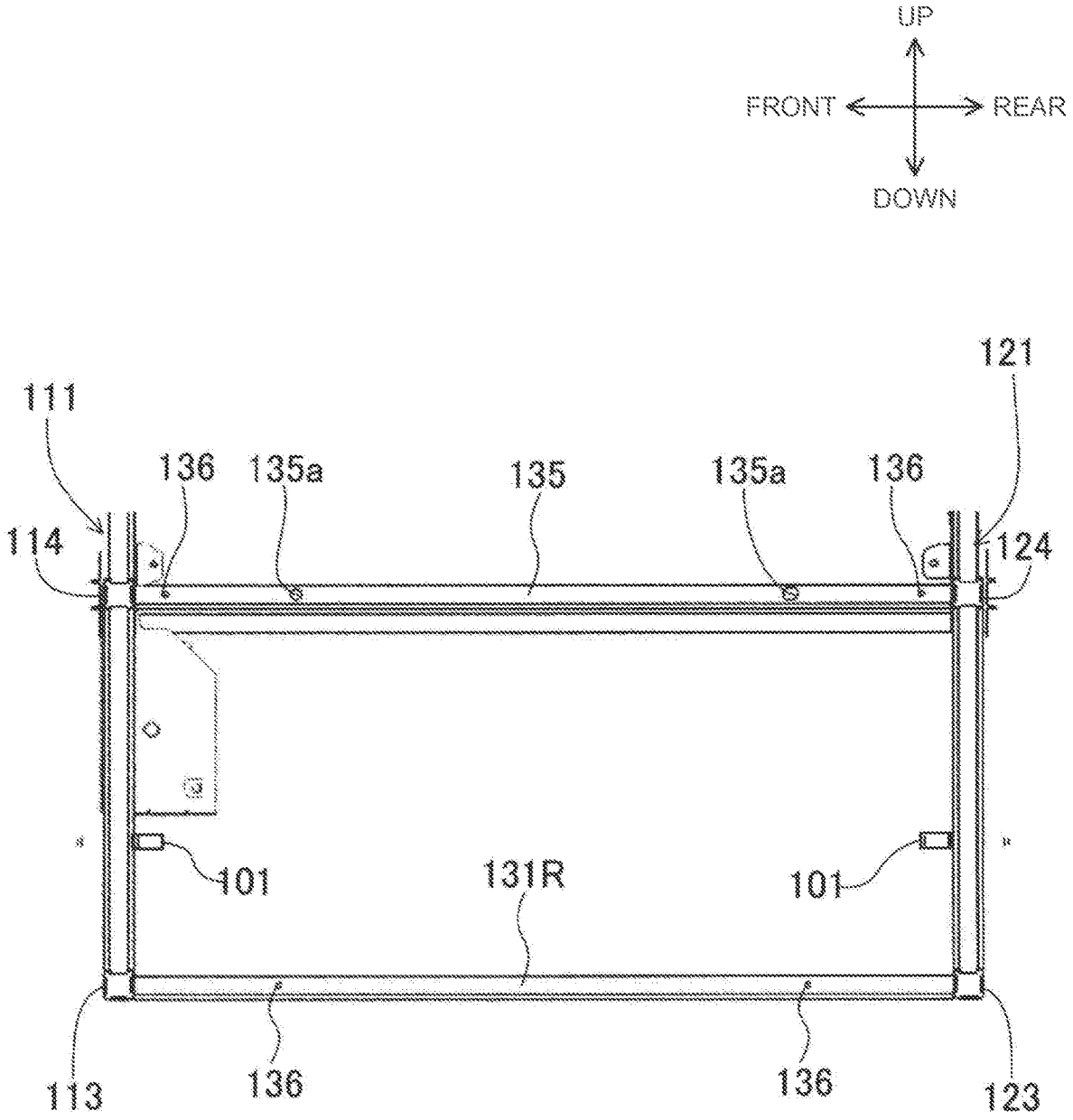
FIG. 10 is an enlarged side view showing an attachment portion of the paper-feed base member in the skeleton frame in the enlarged manner.

FIG. 10 is a diagram showing a mounting portion of the paper-feed base member 31 in the skeleton frame 100. The lower auxiliary connecting beam 135 of the skeleton frame 100 is formed with a pair of positioning holes 135*a* arranged at an interval in the front-rear direction. As will be described later, each of the boss portions 31*d* of the paper-feed base member 31 engages (fits) with each of the positioning holes 135*a*. A pair of screw holes 136 for fixing the upper horizontal portion 31*b* of the paper-feed base member 31 are formed on an outer side in the front-rear direction of the pair of positioning holes 135*a*. The pair of screw holes 136 for fixing the lower horizontal portion 31*c* of the paper-feed base member 31 are formed in the lower-end connecting beam 131R at an interval in the front-rear direction. As a result, the skeleton frame 100 has the four screw holes 136 in total for attaching the paper-feed base member 31.

Figure 11:
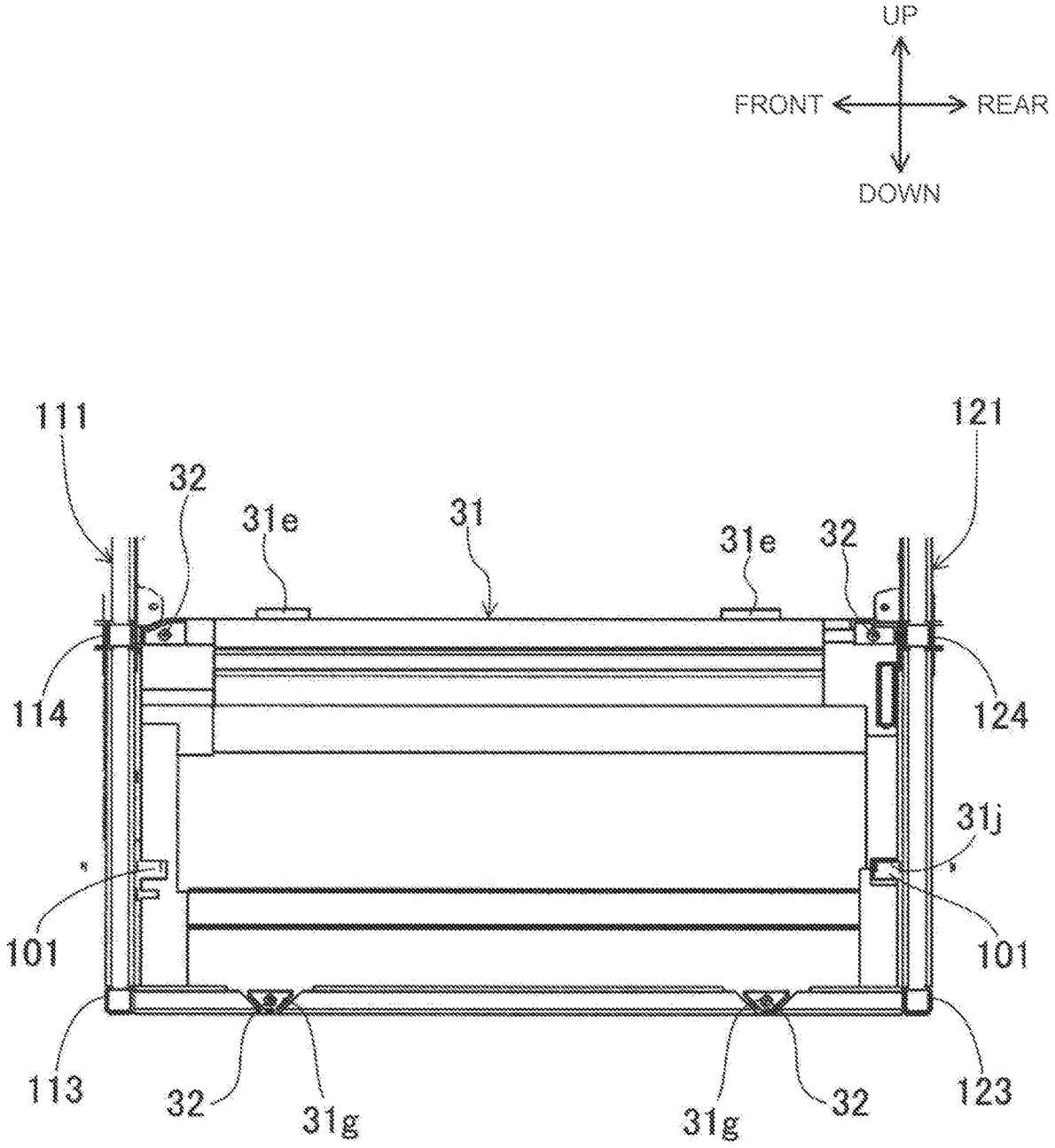
FIG. 11 is a view corresponding to FIG. 10 showing a state in which the paper-feed base member is attached to the skeleton frame.

FIG. 11 shows a state in which the paper-feed base member 31 has been attached to the skeleton frame 100. The paper-feed base member 31 is fixed by inserting the screws 32 into the four mounting holes 31*f* and screwing them in the screw holes 136 in the skeleton frame 100 in a state in which the pair of boss portions 31*d* are engaged with the positioning holes 135*a* of the lower auxiliary connecting beam 135.

Procedure for Attaching the Paper-Feed Base Member 31

Next, the procedure for attaching the paper-feed base member 31 to the skeleton frame 100 will be described with reference to FIGS. 12 to 15. The attachment work of the paper-feed base member 31 described below is performed by a robot, not shown. The attachment work of the paper-feed base member 31 may be performed manually by a person.

Figure 12:
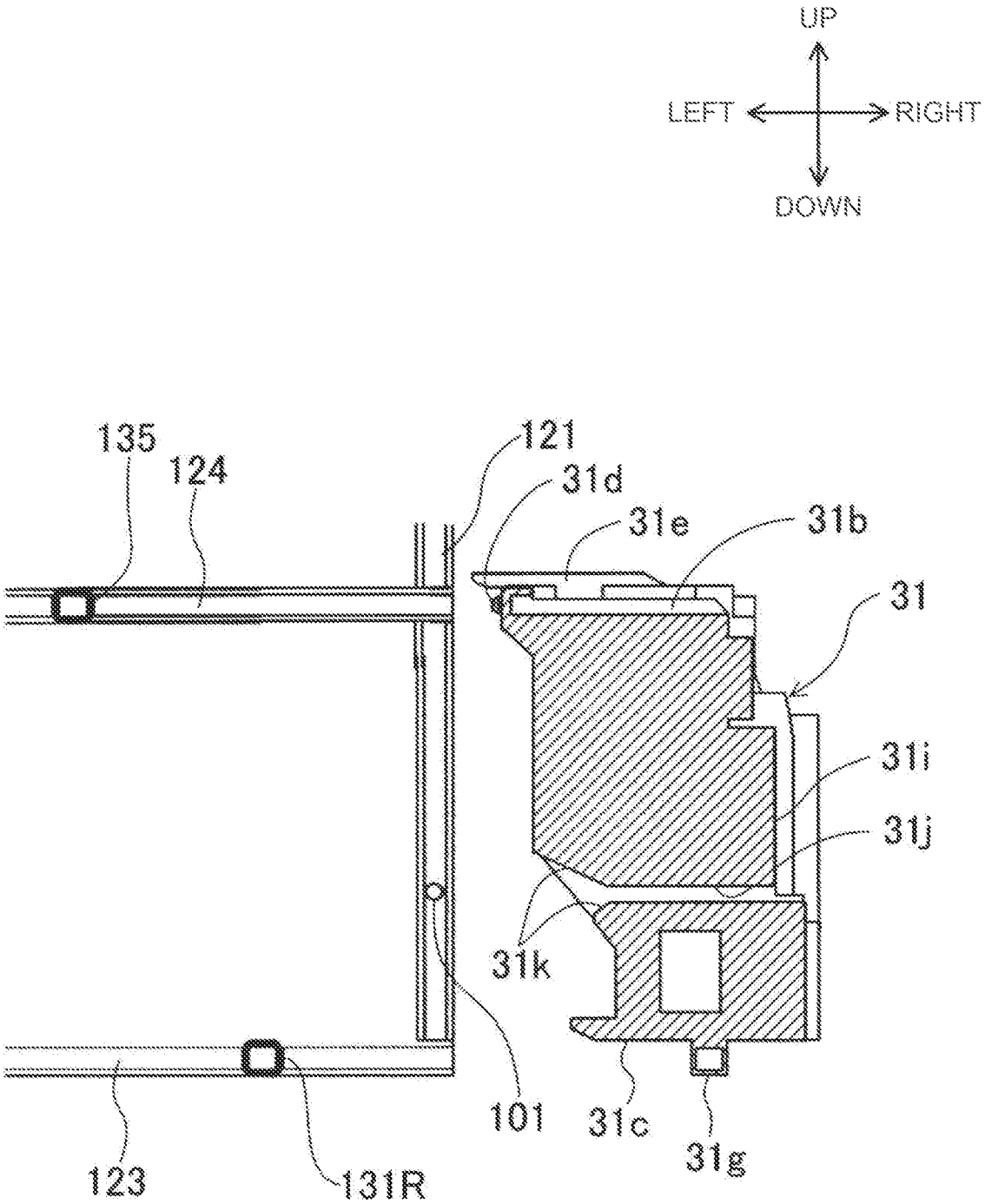
FIG. 12 is an explanatory view for explaining a work of attaching the paper-feed base member to the skeleton frame, and is a view corresponding to an A-A cross section of FIG. 7.

First, the paper-feed base member 31 is held at a preparation position determined in advance. At this preparation position, as shown in FIG. 12, the paper-feed base member 31 is arranged on the outer right side of the skeleton frame 100. At the preparation position, the paper-feed base member 31 is located between the first corner column 111 and the third corner column 121 when viewed from the outer side on the right side, and the boss portion 31*d* of the paper-feed base member 31 is located at a height corresponding to the lower auxiliary connecting beam 135.

Figure 13:
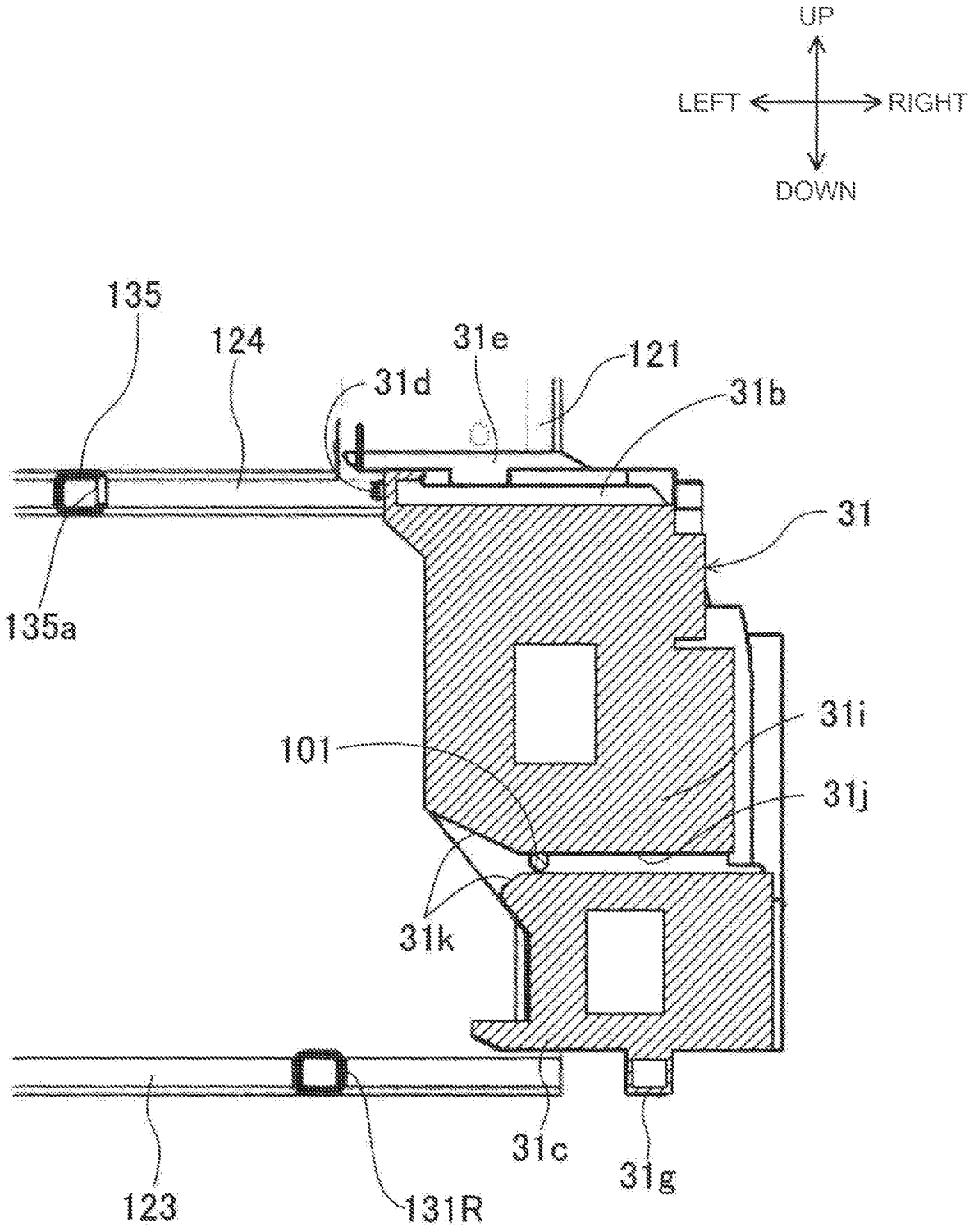
FIG. 13 is an explanatory view for explaining the work of attaching the paper-feed base member to the skeleton frame, and is a view corresponding to the A-A cross section of FIG. 7.

Next, the paper-feed base member 31 is slowly moved from the preparation position to the left side. Then, as shown in FIG. 13, the support shaft 101 of the opening/closing cover 20 provided in a protruding manner on the third corner column 121 enters the guide groove 31*j* of the rear vertical wall portion 31*i*. As a result, the paper-feed base member 31 is guided in the insertion direction (left-right direction) by the support shaft 101. Further, when the support shaft 101 comes into contact with the upper wall surface of the guide groove 31*j*, the paper-feed base member 31 is positioned in the vertical direction.

Figure 14:
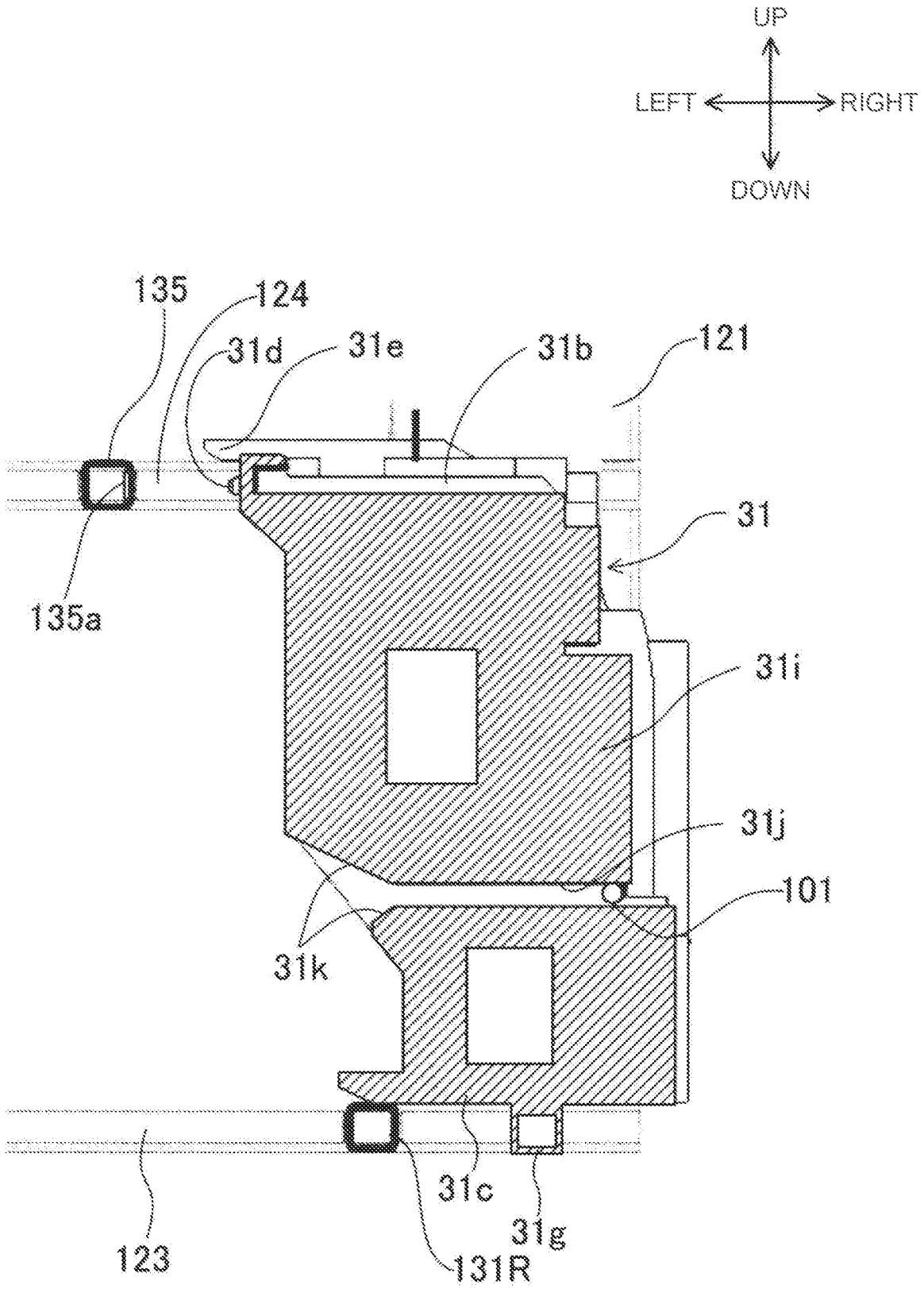
FIG. 14 is an explanatory view for explaining the work of attaching the paper-feed base member to the skeleton frame, and is a view corresponding to the A-A cross section of FIG. 7.

When the paper-feed base member 31 is further moved to the left from the state in FIG. 13, the support shaft 101 relatively moves to the right with respect to the guide groove 31*j* as shown in FIG. 14 and eventually reaches the right end of the guide groove 31*j*.

When the paper-feed base member 31 is further moved to the left from the state of FIG. 14, the support shaft 101 comes out of the guide groove 31*j* and loses support in a gravity direction (vertical direction) of the paper-feed base member 31 by the support shaft 101, but in this embodiment, as shown in FIG. 14, the support of the support shaft 101 from below the paper-feed base member 31 by the lower-end connecting beam 131R starts before the support shaft 101 comes out of the guide groove 31*j*.

Figure 15:
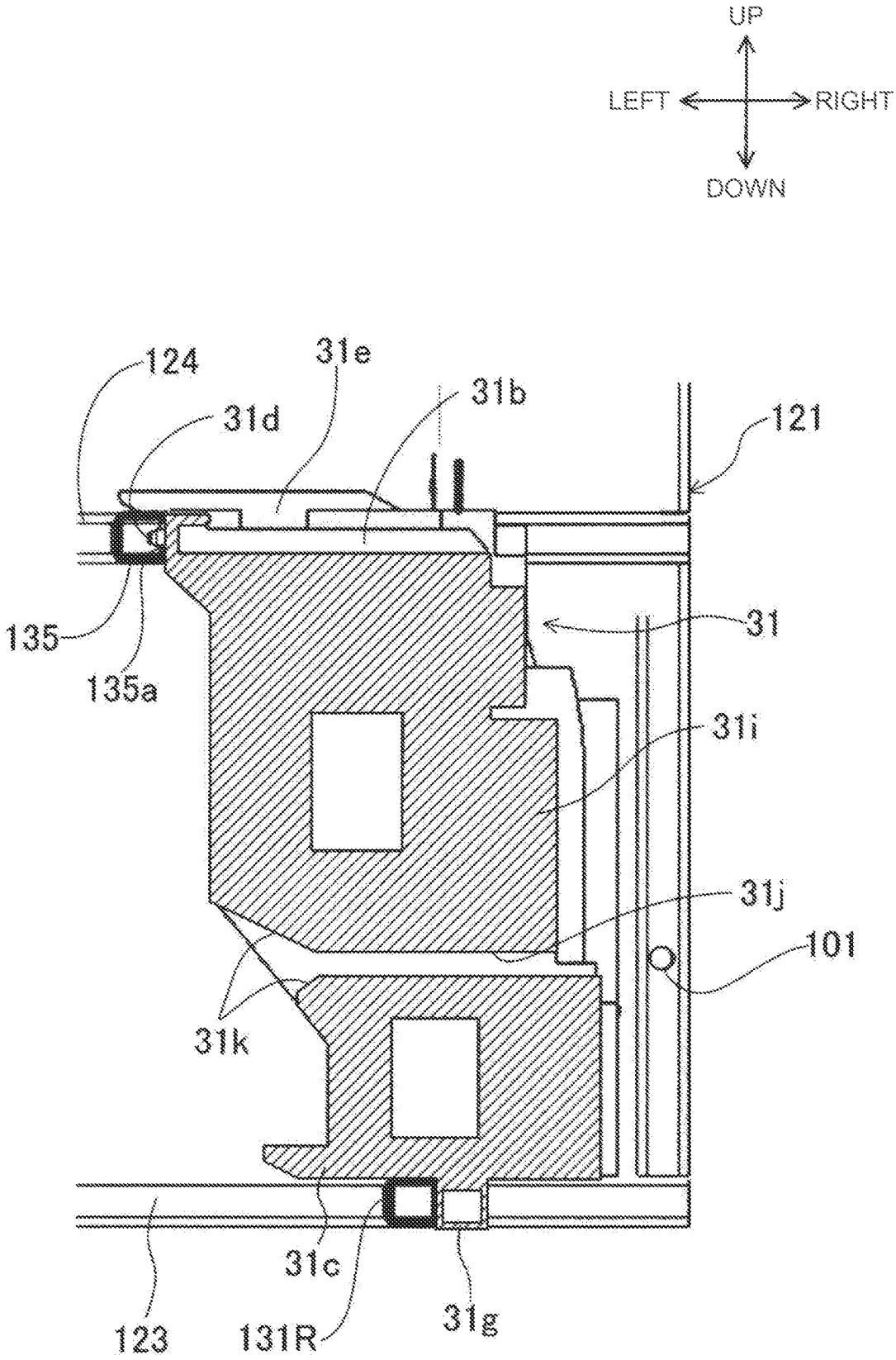
FIG. 15 is an explanatory view for explaining the work of attaching the paper-feed base member to the skeleton frame, and is a view corresponding to the A-A cross section of FIG. 7.

Then, after the support shaft 101 comes out of the guide groove 31*j*, the paper-feed base member 31 is supported from below only by the lower-end connecting beam 131R, and by further moving the paper-feed base member 31 to the left side in this state, as shown in FIG. 15, the boss portion 31*d* of the paper-feed base member 31 engages with the positioning hole 135*a* of the lower auxiliary connecting beam 135 so that the paper-feed base member 31 is positioned.

Figure 16:
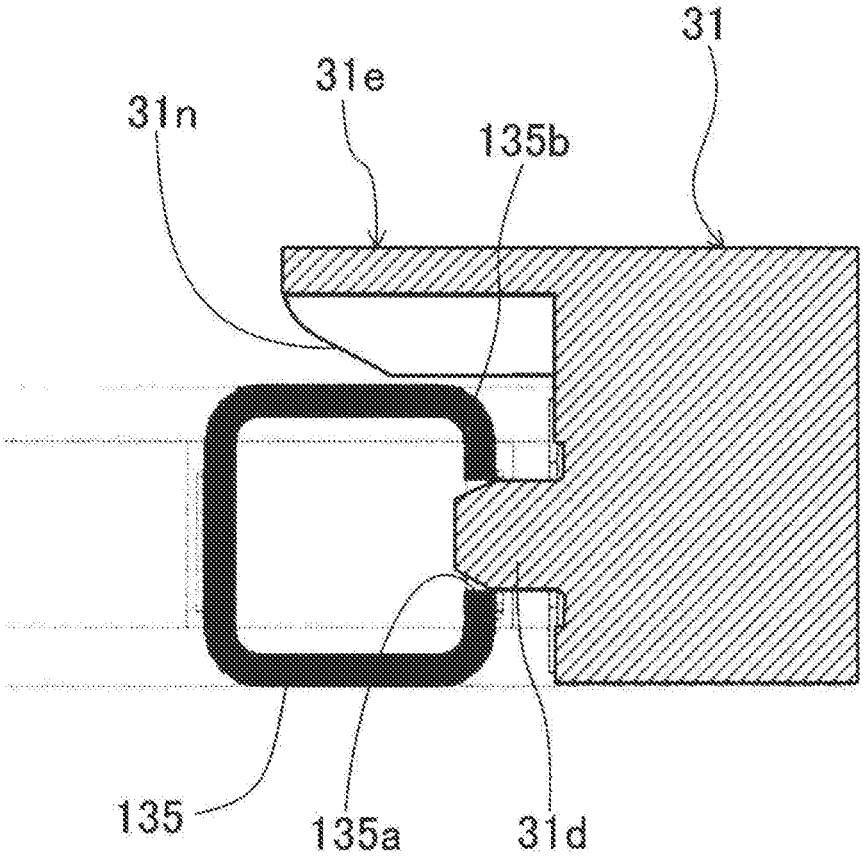
FIG. 16 is an explanatory diagram for explaining a process in which a boss portion of the paper-feed base member engages with a positioning hole.

During this positioning, as shown in FIG. 16, an inclined edge 31*n* (inclined portion) of the protruding guide portion 31*e* is brought into contact with the upper right edge portion 135*b* of the lower auxiliary connecting beam 135, and guides the paper-feed base member 31 to a regular mounting height. As a result, the pair of boss portions 31*d* of the paper-feed base member 31 smoothly engages with the pair of positioning holes 135*a* of the lower auxiliary connecting beam 135. After the positioning of the paper-feed base member 31 is completed, the screws 32 are inserted into the four mounting holes 31*f* of the paper-feed base member 31 and screwed into the screw holes 136 formed in the skeleton frame 100, whereby the attachment work of the paper-feed base member 31 is completed.

Effect of the Present Embodiment

As described above, in the present embodiment, the skeleton frame 100 includes the first corner column 111 and the third corner column 121 facing each other at an interval, the pair of front and rear support shafts 101 protruding inward from the inner side surface of each of the corner columns 111 and 121, respectively, and the opening/closing cover 20 that is rotatably supported on the lower end portion by the pair of front and rear support shafts 101 and is capable of opening/closing the space between the first corner column 111 and the third corner column 121 by rotating around the pair of front and rear support shafts 101 as fulcrums. The paper-feed base member 31 moves horizontally from the outer side of the skeleton frame 100 through between the first corner column 111 and the third corner column 121, and is attached inside the skeleton frame 100.

Then, in the present embodiment, the rear support shaft 101 is also used as a guide portion that guides the paper-feed base member 31 when the paper-feed base member 31 is inserted into the skeleton frame 100 from between the first corner column 111 and the third corner column 121. According to this structure, the guide portion for attaching the paper-feed base member 31 to the skeleton frame 100 can be configured easily and inexpensively without increasing the weight.

Further, in the present embodiment, the skeleton frame 100 has the lower-end connecting beam 131 (support beam) that extends in the width direction orthogonal to the insertion direction in the paper-feed base member 31, and supports the paper-feed base member 31 from below when the paper-feed base member 31 is inserted into the skeleton frame 100, and the lower auxiliary connecting beam 135 (positioning beam) that extends in the width direction orthogonal to the insertion direction of the paper-feed base member 31 and comes into contact with the front side surface in the insertion direction of the paper-feed base member 31 in a state in which the attachment of the paper-feed base member 31 has been completed. The lower auxiliary connecting beam 135 has the positioning hole 135*a* for positioning the paper-feed base member 31 by engaging with the boss portion 31*d* (engagement portion) formed on the front side surface in the insertion direction of the paper-feed base member 31 in the state in which the attachment of the paper-feed base member 31 has been completed.

According to this structure, the insertion work of the paper-feed base member 31 can be performed while the paper-feed base member 31 is supported from below by the lower-end connecting beam 131 that is a part of the skeleton frame 100. Therefore, a state in which the paper-feed base member 31 is cantilevered by the robot can be avoided as much as possible, and the attachment posture of the paper-feed base member 31 can be stabilized. As a result, the boss portion 31*d* of the paper-feed base member 31 can be smoothly engaged with the positioning hole 135*a* of the lower auxiliary connecting beam 135.

Further, in the present embodiment, the paper-feed base member 31 has the guide groove 31*j* extending in the insertion direction thereof. The guide groove 31*j* is formed having a U-shaped cross section that opens to the outer side in the width direction of the paper-feed base member 31, and the upper wall surface of the guide groove 31*j* functions as a supported surface supported from below by the support shaft 101 on the rear side in a process of inserting the paper-feed base member 31. Then, the lower-end connecting beam 131 is arranged so as to start the support of the paper-feed base member 31 before the rear end in the insertion direction on the supported surface finishes passing through the rear support shaft 101 in the process of inserting the paper-feed base member 31 and to continue the support until the attachment of the paper-feed base member 31 is completed (see FIGS. 14 and 15).

According to this structure, since the support by the lower-end connecting beam 131 starts before the paper-feed base member 31 finishes passing through the support shaft 101, the posture of the paper-feed base member 31 can be stabilized even after the paper-feed base member 31 finishes passing through the support shaft 101. Therefore, the attachment work of the paper-feed base member 31 by the robot can be performed with higher accuracy.

The paper-feed base member 31 has a protruding guide portion 31*e* on the upper side of the pair of boss portions 31*d*. The protruding guide portion 31*e* is formed with the inclined edge 31*n* that is inclined upward toward the front side in the insertion direction of the paper-feed base member 31. The inclined edge 31*n* is formed so as to guide the boss portion 31*d* of the paper-feed base member 31 toward the positioning hole 135*a* of the lower auxiliary connecting beam 135 while in contact with the lower auxiliary connecting beam 135 with the movement of the paper-feed base member 31 immediately before the attachment of the paper-feed base member 31 is completed (see FIG. 16).

According to this structure, the boss portion 31*d* of the paper-feed base member 31 can be guided to the positioning hole 135*a* by the inclined edge 31*n* of the protruding guide portion 31*e* and thus, even if the vertical position of the boss portion 31*d* is slightly displaced due to a dimensional error of the lower-end connecting beam 131 or the paper-feed base member 31, the boss portion 31*d* can be reliably engaged with the positioning hole 135*a*.

Modification

Figure 17:
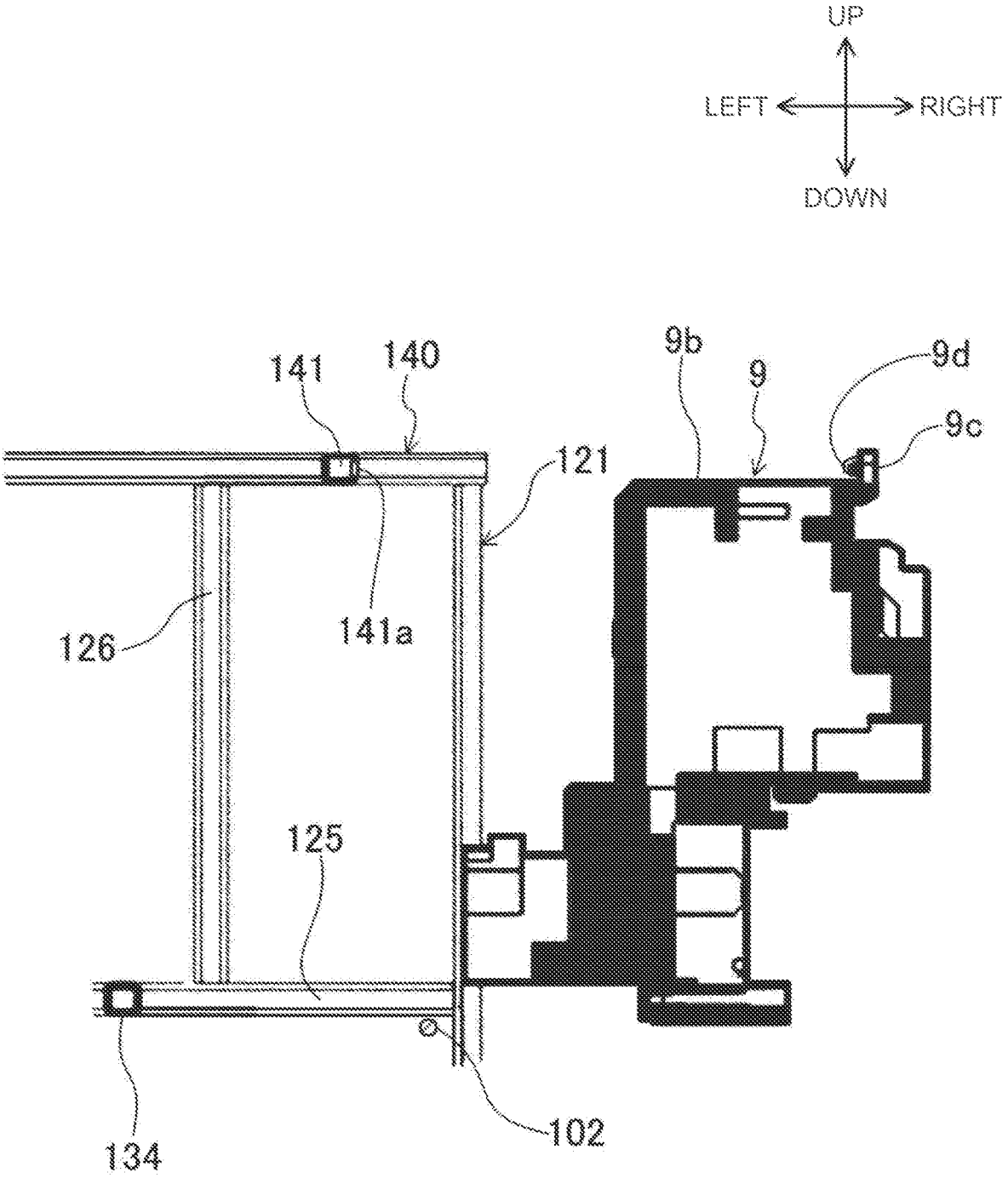
FIG. 17 is an explanatory view for explaining the work of attaching the paper-feed base member to the skeleton frame in a modification example, and is a view corresponding to the A-A cross section of FIG. 7.
Figure 18:
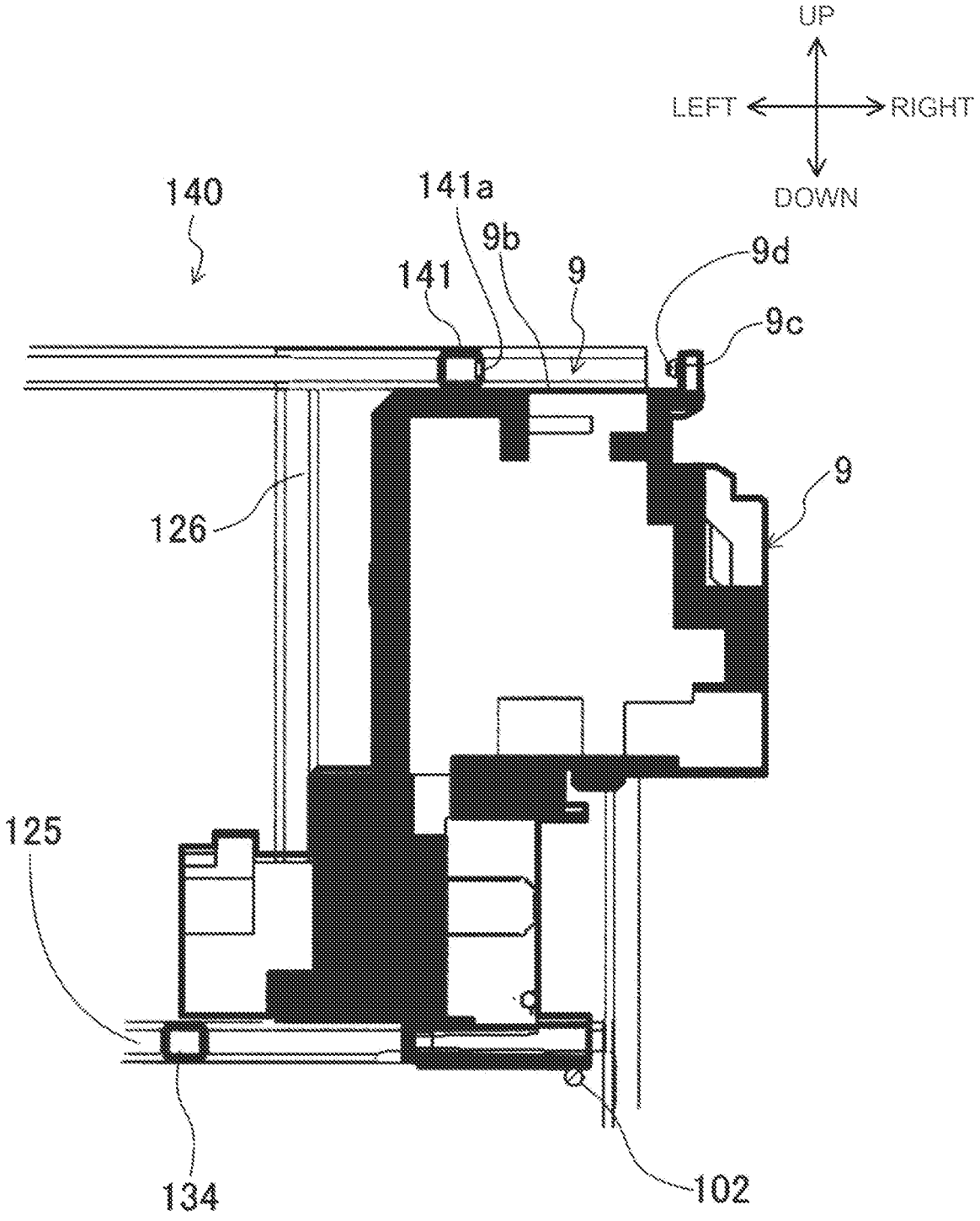
FIG. 18 is an explanatory view for explaining the work of attaching the paper-feed base member to the skeleton frame in the modification example, and is a view corresponding to the A-A cross section of FIG. 7.

FIGS. 17 and 18 show a modification of the embodiment. In the above embodiment, the support shaft 101 is used as a guide portion when the paper-feed base member 31 (specific member) is attached to the skeleton frame 100, whereas in this modification, the engaging shaft 102 of the hook member 22 is used as a guide portion when the ejection unit 9 (specific member) is to be attached to the skeleton frame 100.

As shown in FIGS. 17 and 18, the ejection unit 9 has the hollow case-shaped housing 9*b*, a pair of protruding plate portions 9*c* (only one is shown in each figure) stood upright on the right end portion of the upper surface of the housing 9*b* and aligned at an interval in the front-rear direction, and a boss portion 9*d* provided in a protruding manner on the left side surface of each of the protruding plate portions 9*c*. A positioning hole 141*a* is formed at a position corresponding to the pair of boss portions 9*d* in the cross beam 141 on the right side. Although not shown, in the housing 9*b* of the ejection unit 9, mounting holes through which screws are passed are formed similarly to the paper-feed base member 31 of the above embodiment, and in the cross beam 141 on the right side and the upper auxiliary connecting beam 134, screw holes with which screws are screwed are formed.

Figure 19:
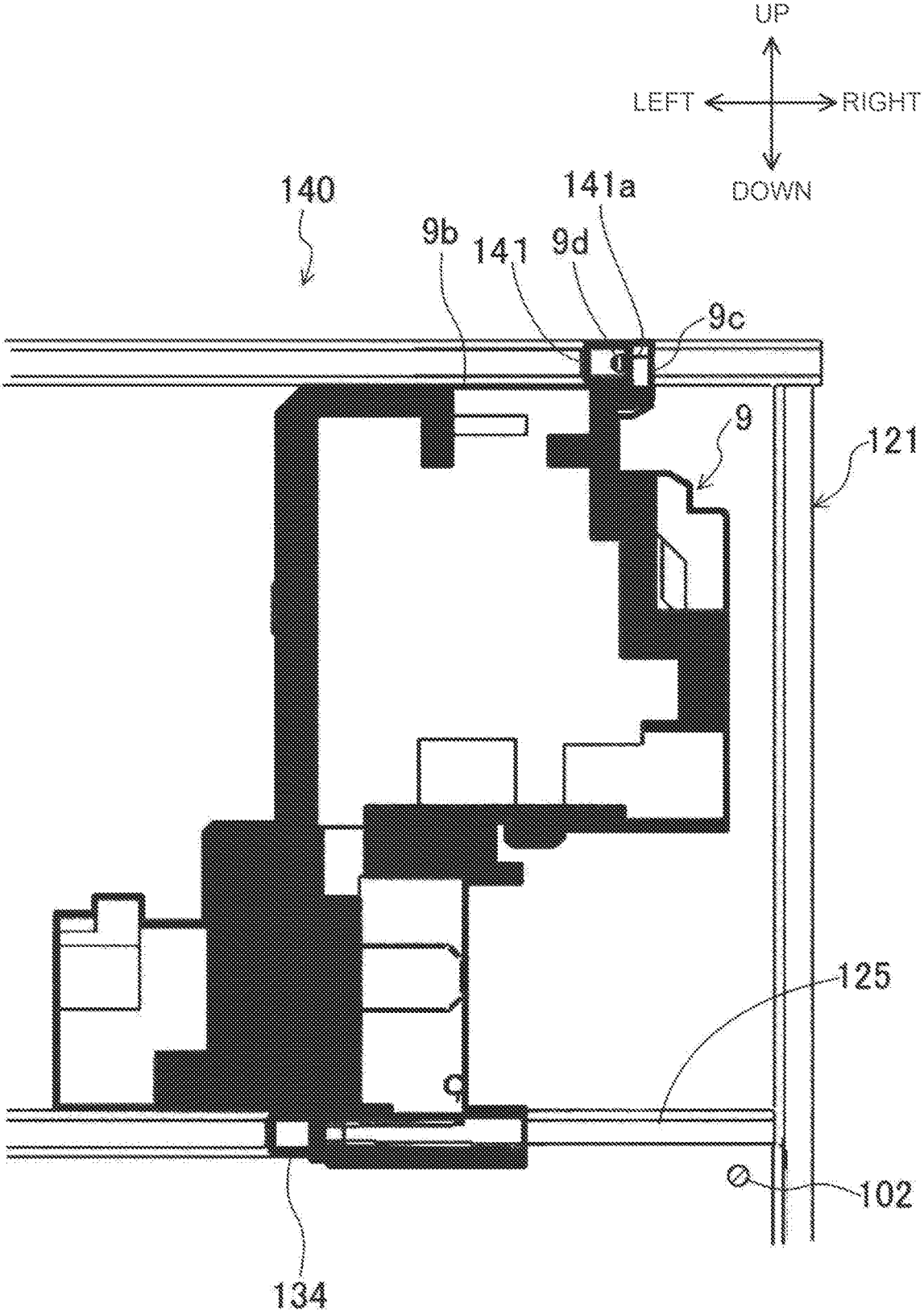
FIG. 19 is an explanatory view for explaining the work of attaching the paper-feed base member to the skeleton frame in the modification example, and is a view corresponding to the A-A cross section of FIG. 7.

FIG. 17 shows a state in which the ejection unit 9 is at the preparation position. When the ejection unit 9 is moved to the left from this state, the lower surface (corresponding to the supported surface) of the housing 9*b* is supported by the front and rear engaging shafts 102, and when the ejection unit 9 is further moved to the left, as shown in FIG. 18, the front and rear engaging shafts 102 (only one of them is shown in the figure) reach the right end of the lower surface of the ejection unit 9, and substantially at the same time, the support of the lower surface of the ejection unit 9 by the upper auxiliary connecting beam 134 starts. Then, when the ejection unit 9 is further moved to the left, the support of the lower surface of the ejection unit 9 by the front and rear engaging shafts 102 is finished, and the ejection unit 9 is supported from below only by the upper auxiliary connecting beam 134, and when the ejection unit 9 is further moved to the left from this state, as shown in FIG. 19, the boss portion 9*d* of the ejection unit 9 engages with the positioning hole 141*a* of the cross beam 141 so as to position the ejection unit 9. In this state, the attachment work of the ejection unit 9 is completed by inserting a screw into a mounting hole, not shown, of the ejection unit 9 and screwing it into the screw hole formed in the skeleton frame 100.

According to this modification, the engaging shaft 102 of the hook member 22 is used as a guide portion when the ejection unit 9 is to be attached in the skeleton frame 100. As a result, the guide portion of the ejection unit 9 can be easily and inexpensively configured without increasing the weight.

Another Embodiment

In the above embodiment, the guide groove 31*j* is provided only at the rear end portion of the paper-feed base member 31, and the paper-feed base member 31 is guided only by the support shaft 101 on the rear side, but the present disclosure is not limited to this, and the guide grooves 31*j* may be provided on both front and rear sides of the paper-feed base member 31, for example, so that the paper-feed base member 31 is guided by the front and rear support shafts 101. As a result, during the insertion work of the paper-feed base member 31, the paper-feed base member 31 can be guided while being supported at both ends by the front and rear support shafts 101, and the insertion posture of the paper-feed base member 31 can be further stabilized. It is needless to say that the guide groove 31*j* may be provided only at the front end portion of the paper-feed base member 31.

In the modification, the lower surface (supported surface) of the ejection unit 9 is supported by the pair of front and rear engaging shafts 102, but the lower surface (supported surface) of the ejection unit 9 may be supported only by one of the engaging shafts 102.

Further, the supported surface supported by the support shaft 101 does not necessarily have to be the upper wall surface of the guide groove 31*j*, and as shown in the modification, it may be the entire lower surface of the specific member (ejection unit 9 in the modification). Further, in the modification, a guide groove may be formed on the side surface in the width direction of the ejection unit 9 similarly to the embodiment, and the upper wall surface of the guide groove may be supported by the engaging shaft 102. Further, in the modification, the inclined edge 31*n* (an example of the inclined portion) may be provided similarly to the embodiment.

Further, in the above-described embodiment and modification, the paper-feed base member 31 and the ejection unit 9 have been described as examples of the specific members, but the present disclosure is not limited to this, and the image forming unit 10 or the fixing unit 8 may be employed as the specific members, for example.

In the above-described embodiment and modification, a copying machine has been described as an example of the image forming apparatus 1, but the present disclosure is not limited to this, and the image forming apparatus 1 may be configured by a printer, a facsimile, a multifunction device (MFP) or the like.

As described above, the present disclosure is useful for the image forming apparatus, and is particularly useful for the printers, facsimiles, copying machines, or multifunction devices (MFPs).

What is claimed is:

1. An image forming apparatus including a skeleton frame formed by combining hollow columns and cross beams and a specific member attached in the skeleton frame, wherein the skeleton frame has a pair of corner columns facing each other at an interval and includes a pair of support shafts projecting inward from respective inner side surfaces in the pair of corner columns and an opening/closing member that is rotatably supported on a lower end portion by the pair of support shafts and is capable of opening/closing a space between the pair of corner columns by rotating around the pair of support shafts as fulcrums;

the specific member is attached inside the skeleton frame by moving horizontally from an outer side of the skeleton frame through between the pair of corner columns; and at least one of the pair of support shafts is also used as a guide portion that guides the specific member when the specific member is inserted into the skeleton frame from between the pair of corner columns.

2. The image forming apparatus according to claim 1, wherein the skeleton frame has a support beam that extends in a width direction orthogonal to an insertion direction of the specific member with respect to the skeleton frame and supports the specific member from below when the specific member is inserted into the skeleton frame and a positioning beam that extends in the width direction of the specific member and comes into contact with a front side surface in the insertion direction of the specific member in a state in which attachment of the specific member is completed; and the positioning beam has an engaged portion that positions the specific member by engaging with an engaging portion formed on the front side surface in the insertion direction of the specific member in the state in which the attachment of the specific member is completed.

3. The image forming apparatus according to claim 2, wherein the specific member has a supported surface that extends in the insertion direction of the specific member and is supported from below by the guide portion in a process of inserting the specific member; and the support beam is arranged so as to start support of the specific member before a rear end portion in the insertion direction of the specific member on the supported surface finishes passing through the guide portion in the process of inserting the specific member and to continue the support until the attachment of the specific member is completed.

4. The image forming apparatus according to claim 3, wherein the specific member has an inclined portion that is located on an upper side of the engaging portion and is inclined upward toward a front side in the insertion direction of the specific member; and the inclined portion is formed so as to guide an engaging portion of the specific member toward the engaged portion of the positioning beam while in contact with the positioning beam as the specific member moves immediately before the attachment of the specific member is completed.

5. The image forming apparatus according to claim 3, wherein a groove portion having a U-shaped cross section that extends in the insertion direction of the specific member and opens to an outer side in the width direction is formed on one side surface in the width direction of the specific member; and the supported surface is composed of an upper wall surface of the groove portion.

6. The image forming apparatus according to claim 1, further comprising:

a paper-feed cassette that accommodates a sheet, an image forming portion that forms an image on the sheet, and a paper-feed base member provided on a side of the paper-feed cassette and forms a guide surface that guides the sheet along a specific sheet conveying path, wherein the specific member is the paper-feed base member.

7. An image forming apparatus including a skeleton frame formed by combining hollow columns and cross beams and a specific member attached in the skeleton frame, wherein the skeleton frame has a pair of corner columns facing each other at an interval and includes a pair of support shafts projecting inward from respective inner side surfaces in the pair of corner columns, an opening/closing member that is rotatably supported on a lower end portion by the pair of support shafts and is capable of opening/closing a space between the pair of corner columns by rotating around the pair of support shafts as fulcrums, a pair of hook members that are attached to the opening/closing member and project inward in an opening/closing direction of the opening/closing member, and a pair of engaging shafts that are provided in a protruding manner on an inner side surface of a sheet metal member connected to each of the pair of corner columns and hold the opening/closing member in a closed state by engaging with the pair of hook members when the opening/closing member shifts from an open state to the closed state;

the specific member is attached inside of the skeleton frame by moving horizontally from an outer side of the skeleton frame through between the pair of corner columns; and at least one of the pair of engaging shafts is also used as a guide portion that guides the specific member when the specific member is inserted into the skeleton frame from between the pair of corner columns.

8. The image forming apparatus according to claim 7, wherein the specific member is an ejection unit that ejects a sheet after image formation into an ejection tray provided on an upper side of the skeleton frame.

* * * * *